US009573015B2

(12) United States Patent
Hall

(10) Patent No.: US 9,573,015 B2
(45) Date of Patent: Feb. 21, 2017

(54) METHODS OF USING A WEIGHT HOLDING DEVICE

(71) Applicant: William B. Hall, Evanston, IL (US)

(72) Inventor: William B. Hall, Evanston, IL (US)

( * ) Notice: Subject to any disclaimer, the term of this patent is extended or adjusted under 35 U.S.C. 154(b) by 0 days.

(21) Appl. No.: 15/279,233

(22) Filed: Sep. 28, 2016

(65) Prior Publication Data

US 2017/0014670 A1 Jan. 19, 2017

Related U.S. Application Data

(63) Continuation of application No. 14/329,961, filed on Jul. 13, 2014, now Pat. No. 9,504,867.

(60) Provisional application No. 61/856,714, filed on Jul. 21, 2013.

(51) Int. Cl.

| | |
|---|---|
| ***A63B 21/06*** | (2006.01) |
| ***A63B 21/078*** | (2006.01) |
| ***A63B 21/072*** | (2006.01) |
| ***A63B 23/12*** | (2006.01) |

(52) U.S. Cl.
CPC ..... *A63B 21/4035* (2015.10); *A63B 21/0726* (2013.01); *A63B 23/12* (2013.01)

(58) Field of Classification Search
CPC ..... A63B 21/00; A63B 21/06; A63B 21/06; A63B 21/065; A63B 21/1403; A63B 21/1434; A63B 21/1438; A63B 21/1442; A63B 26/00; A63B 21/4035
USPC ..... 482/92, 93, 104–108
See application file for complete search history.

(56) References Cited

U.S. PATENT DOCUMENTS

| | | | | | |
|---|---|---|---|---|---|
| 1,824,027 | A * | 9/1931 | Lundquist | B66C 1/18 | 190/27 |
| 3,098,315 | A * | 7/1963 | Bonon | D05B 77/00 | 206/320 |
| 3,143,266 | A * | 8/1964 | Imatake | A45F 5/10 | 206/150 |
| 3,167,344 | A * | 1/1965 | Applegarth | B66C 1/18 | 294/152 |
| 3,554,554 | A * | 1/1971 | Zane | A63B 53/14 | 473/206 |
| 3,958,731 | A * | 5/1976 | Riedle | A45F 5/102 | 190/108 |
| 4,059,302 | A * | 11/1977 | Barthule | B66C 1/18 | 294/74 |
| 4,091,977 | A * | 5/1978 | Luttbeg | A63B 55/00 | 206/315.3 |
| 4,368,883 | A * | 1/1983 | Tiktin | A63B 21/065 | 2/162 |
| 4,487,412 | A * | 12/1984 | Meeko | A63B 21/4021 | 482/106 |
| 4,558,896 | A * | 12/1985 | Farnworth | A45F 5/1026 | 294/153 |
| 4,722,523 | A * | 2/1988 | Yang | A63B 17/04 | 482/106 |

(Continued)

*Primary Examiner* — Stephen Crow
*Assistant Examiner* — Garrett Atkinson
(74) *Attorney, Agent, or Firm* — Andover Patents, LLC; Daniel N. Beinart

(57) ABSTRACT

A method of using a weight holding device includes the steps of positioning the strap behind a bar, wherein the handgrip is positioned opposite the strap-separating component, and the strap is suspended from the handgrip, raising the lowest portion of the strap, bringing the handgrip through the raised portion of the strap, and pulling the handgrip upwards so that the strap tightens around the bar.

17 Claims, 23 Drawing Sheets

(56) References Cited

U.S. PATENT DOCUMENTS 4,801,137 A * 1/1989 Douglass ..... A63B 21/075 482/108
4,807,876 A * 2/1989 Lothar ..... A63B 71/00 482/106
5,004,231 A * 4/1991 Alread ..... A63B 21/4021 2/159
5,081,715 A * 1/1992 Mascia ..... A41D 13/082 2/20
5,090,691 A * 2/1992 Pollock ..... A63B 21/151 16/426
5,096,248 A * 3/1992 Ryan ..... A45F 5/10 294/150
5,180,352 A * 1/1993 Sreter ..... A63B 21/072 482/1
5,350,345 A * 9/1994 Frey ..... A63B 21/072 482/105
5,353,440 A * 10/1994 Meldeau ..... A41D 19/01547 2/161.1
5,511,788 A * 4/1996 Manley ..... A63B 69/0059 473/212
5,628,714 A * 5/1997 Philipson ..... A63B 21/0552 482/102
5,809,570 A * 9/1998 Grover ..... A41D 19/01547 2/161.1
5,813,950 A * 9/1998 Parker ..... A41D 13/082 2/20
5,846,169 A * 12/1998 Tscheschlog ..... A63B 21/4001 224/265
6,450,929 B1 * 9/2002 Markham ..... A63B 21/0552 482/121
6,494,818 B1 * 12/2002 Richmond ..... A63B 21/0004 482/121
6,834,397 B1 * 12/2004 Murphy ..... A63B 69/0066 2/161.1
6,966,589 B1 * 11/2005 Grbic ..... A45C 13/30 294/150
6,976,719 B2 * 12/2005 Agayof ..... A45C 13/30 24/16 PB
7,008,355 B2 * 3/2006 Emick ..... A63B 21/4001 2/16
7,344,485 B1 * 3/2008 Simpson ..... A63B 21/0004 482/121
7,946,967 B2 * 5/2011 Berhanu ..... A63B 21/072 482/109
7,963,891 B1 * 6/2011 Zeaman ..... A63B 21/4035 482/104
8,757,455 B2 * 6/2014 Smalley ..... A41D 7/00 2/67
8,764,614 B2 * 7/2014 Emick ..... A63B 23/03525 482/48
2007/0149368 A1 * 6/2007 Koch ..... A61H 1/024 482/131
2007/0232404 A1 * 10/2007 Begert ..... A63B 21/0004 473/216
2010/0004106 A1 * 1/2010 Scheiman ..... A63B 21/4001 482/139
2010/0016132 A1 * 1/2010 Flynn ..... A63B 21/0004 482/122
2010/0261583 A1 * 10/2010 Ferguson ..... A63B 21/151 482/79
2011/0111929 A1 * 5/2011 Allison ..... A63B 21/072 482/108
2014/0302971 A1 * 10/2014 Vining, III ..... A63B 21/0442 482/129

* cited by examiner

METHODS OF USING A WEIGHT HOLDING DEVICE

CROSS-REFERENCE TO RELATED APPLICATIONS

This non-provisional application is a continuation application of U.S. Non-Provisional application Ser. No. 14/329,961, filed Jul. 13, 2014 and entitled "Weight Holding Device", which in turn, claims the benefit of priority to the U.S. Provisional Application Ser. No. 61/856,714, filed Jul. 21, 2013 and entitled "Weight Holding Device". The entire contents of each of the aforementioned applications are incorporated herein by reference in their entirety, as if fully set forth herein.

TECHNICAL FIELD

The present invention relates generally to the field of athletic training equipment, and more particularly to a weight holding device that provides an improved means for holding a weight during physical exercise.

BACKGROUND

Existing weights for an athlete or other person with physical fitness goals, such as dumbbells, weight plates, bars and kettle balls, or exercise apparatuses, such as overhead bars, require a direct grip of the weight by the athlete, thereby presenting a relatively stable force to the athlete. Presentation of a stable force only provides limited challenges, stimuli and recruitment to the athlete's muscles. In addition, an athlete's muscles become accustomed to traditional dumbbell and weight training and when that occurs the muscles are no longer stimulated sufficiently by such training. Furthermore, exercises that are possible with existing weights may become monotonous to an athlete.

It can also be uncomfortable for an athlete to grip existing weights, as the grip required can be stiff and rigid and create undesirable forces on the wrists and other joints of the body.

Therefore a need exists for a weight exercise device that presents an unstable force to a user, thereby integrating additional muscles, providing different challenges, stimuli and recruitment to the user's targeted muscles. There also exists a need for a weight exercise device that reduces the monotony of weight exercises and provides a more comfortable grip that reduces the undesirable forces on the wrists and other joints of the body.

A device constructed according to the principles of the present invention addresses these deficiencies.

SUMMARY

A weight holding device is provided that can include a strap and a strap-separating component attached to the strap. The strap-separating component maintains a separation between two portions of the strap when a weight is suspended from the weight holding device.

In some implementations, the following features can be present in any suitable combination.

In some implementations the strap can be a closed loop and substantially flat.

The strap-separating component can be a substantially flat and rectangular plate having a width that is not greater than the width of the strap. The separation between two portions of the strap is substantially equal to the length of the plate. The plate can be approximately 4 inches in length.

A weight holding device can also include a substantially flat plate cover, where the plate is attached to said strap and enclosed by the plate cover.

The strap-separating component can be comprised of material with strength sufficient for the strap-separating component to substantially maintain its shape without bending when a weight is suspended from the weight holding device. The strap-separating component can be comprised of metal.

A weight holding device can also include a handgrip attached to the strap. The position of the handgrip relative to the strap-separating component may be adjusted. The handgrip can be substantially cylindrical and hollow and the strap can be routed through the handgrip.

An alternate weight holding device is provided that can include a substantially flat strap forming a closed loop, a substantially flat and rectangular plate attached to the strap, and a handgrip attached to the strap. The plate maintains a separation that is substantially equal to the length of the plate between two portions of the strap when a dumbbell or weighted bar is suspended from the weight holding device.

The strap-separating component can be a substantially cylindrical sheath for enclosing a weight, where the sheath further comprises two or more hooks and two or more brackets, where the hooks provide suspension points for the strap and the brackets are for routing said strap. The sheath can comprise two sections joined by a hinge.

In some implementations, the following features can be present in any suitable combination.

The plate can be approximately 4 inches in length.

A weight holding device can also include a substantially flat plate cover, where the plate is attached to the strap and enclosed by the plate cover.

The plate can be comprised of material with strength sufficient for the plate to substantially maintain its shape without bending when a weight is suspended from the weight holding device. The plate can be comprised of metal.

The position of the handgrip relative to the plate may be adjusted. The handgrip can be substantially cylindrical and hollow and the strap can be routed through the handgrip.

Other objects and features of the present invention will become apparent from the detailed description considered in connection with the accompanied drawings. It is to be understood however, that the drawings are designed as an illustration only and not as definition of the limits of the invention. It is obvious that many changes and modifications may be made thereunto without departing from the spirit and scope of the invention.

DETAILED DESCRIPTION

Figure 1:
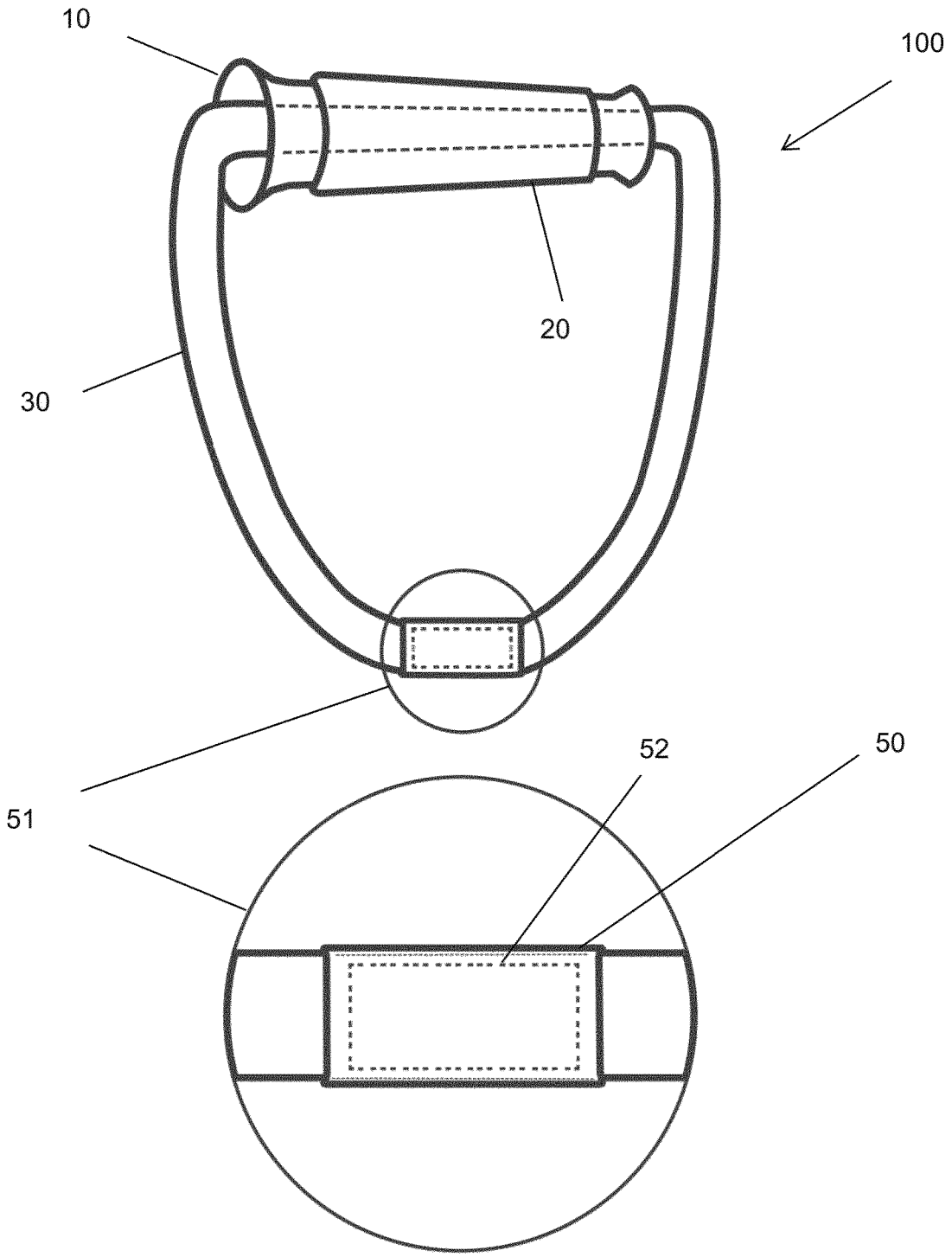
FIG. 1 depicts a view of a first embodiment of a weight holding device in accordance with principles of the present invention.

An embodiment of a weight holding device 100, as depicted in FIG. 1, comprises a handgrip 10, a grip cushion 20, a strap 30, a plate cover 50 and a strap-separating component in the form of a plate 40. In FIG. 1, the plate 40 is covered and enclosed by plate cover 50, and thus is not shown in FIG. 1. The detail of the plate cover 50 and the stitching 52 that holds the plate cover in place over the plate 40 is shown in detail view 51. See FIGS. 2-3 for depictions of the individual components of a weight holding device 100, including a plate 40. In some embodiments (not shown) of the weight holding device 100, a grip cushion 20 is not included.

The handgrip 10, which is used by a person using a weight holding device 100 to hold the weight holding device 100 when a weight is suspended from the weight holding device 100, is hollow and substantially cylindrical, and may be made of plastic. The grip cushion 20 may be made of neoprene or other cushioning material. The strap 30 and plate cover 50, each which may be substantially flat, may each comprise a strip of nylon sports webbing or other durable material or fabric with strength sufficient to support an exercise weight. The weight range of an exercise weight to which a weight holding device 100 is attached may vary, depending upon the application and upon the needs of the athlete. For example, an exercise weight may be as little as one pound, as much as 140 pounds, or even more. Depending upon the weight requirements, a weight holding device 100 may be constructed of materials of suitable types and strengths. The plate 40 may be made of steel or other metal or other material with strength sufficient to substantially maintain its shape without bending when a weight is suspended from a weight holding device 100.

The following dimensions are used in the embodiment of a weight holding device 100 that is depicted in FIGS. 1-4H and 8A-11C. However, other dimensions may be used. The dimensions of a plate 40, which in this embodiment is substantially flat and rectangular, are preferably approximately 4 inches in length 41, approximately ⅝ inch in width 42 and approximately 0.038 inch in thickness 43. The length of a strap 30, which in this embodiment is substantially flat, is approximately 39 inches, before attaching its two ends to form a circular strap, i.e., the strap is, or forms, a closed loop. After the ends are overlapped by approximately two inches and sewn, the circumference of the strap 30, which is now in a circular configuration, is approximately 41 inches. The width of a strap 30 is approximately 1.5 inches and the thickness of a strap 30 is approximately 0.038 inches. The length, width and thickness of a plate cover 50, which in this embodiment is substantially flat and rectangular, are approximately 6.5 inches, 1.5 inches, and 0.038 inches, resp. The length, diameter and thickness of a handgrip 10, through which the strap 30 is routed before its ends are attached to each other, are approximately 6 inches, 1.5 inches and 0.076 inches, resp. The length, diameter and thickness of a grip cushion 20 are approximately 5 inches, 1.25 inches and 0.038 inches, resp.

The plate 40 provides a weight holding device 100 with the advantage of keeping the weight, e.g., a dumbbell or weighted bar, in a substantially horizontal orientation when suspended by the weight holding device 100, thus making it easier and more comfortable for an athlete during use. It does this by maintaining a separation between the two portions of the strap 30 that suspend the weight, thus resulting in two separated points of suspension 31 and 32. Without a plate 40, the two portions of the strap 30 that suspend the weight would be closer together and thus the weight would rotate about a single point of suspension. This would make it more difficult and less comfortable for an athlete to use the weight. The 4 inch length specified above provides for a preferable separation of approximately 4 inches. However, other separations may be obtained by using a plate 40 with a different length.

Figure 2:
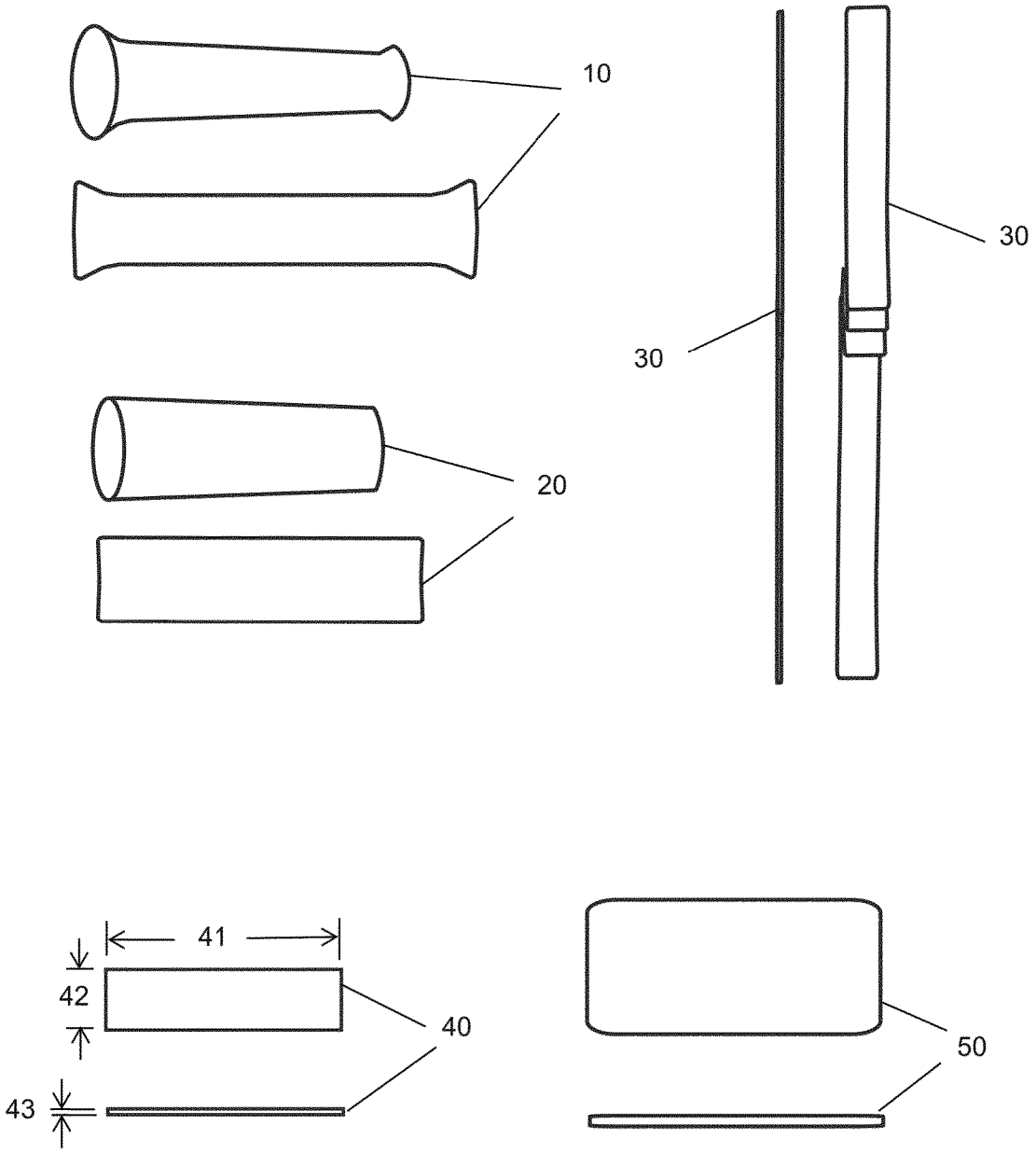
FIG. 2 depicts a view of components of the embodiment of a weight holding device of FIG. 1.
Figure 3:
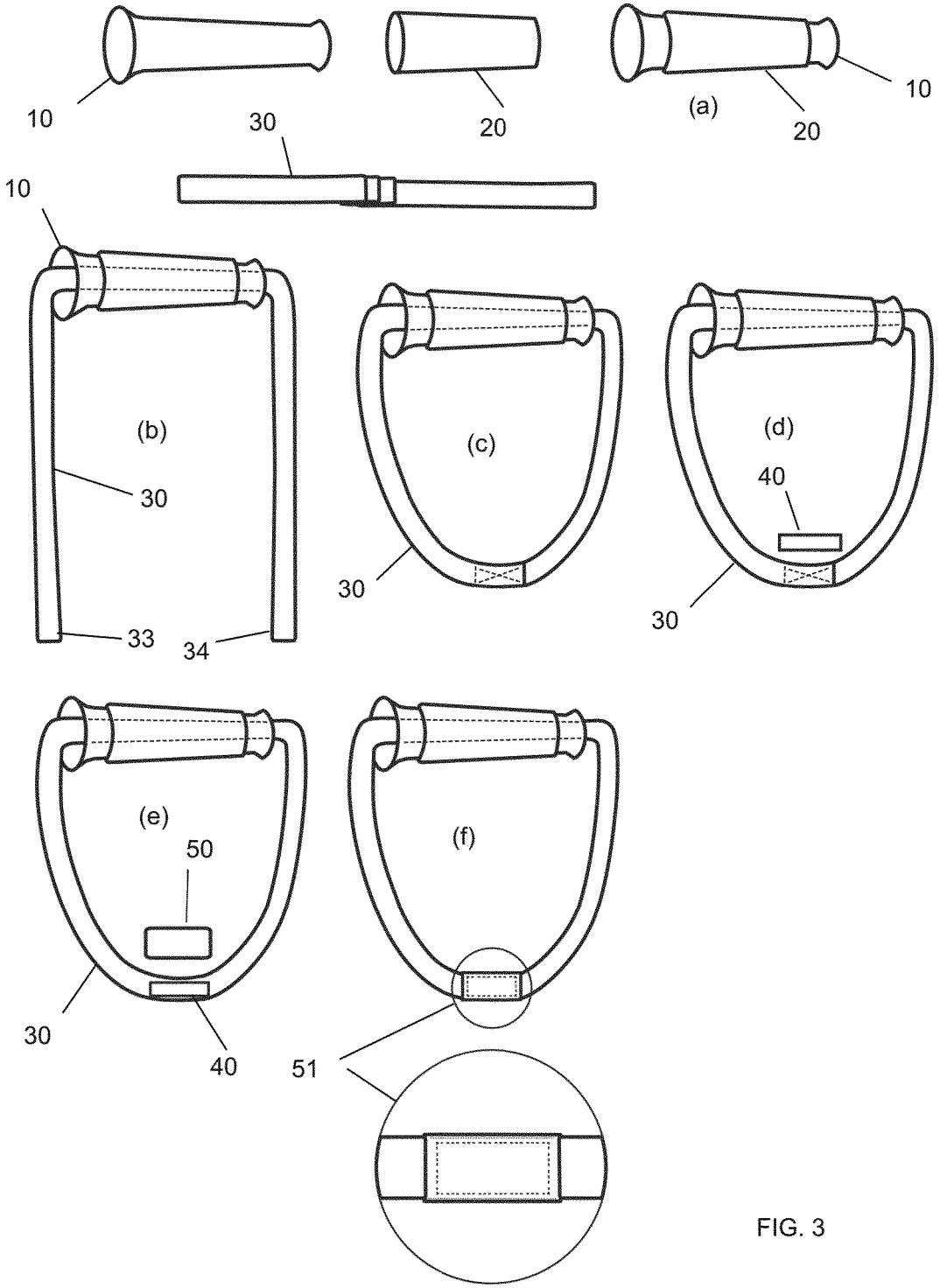
FIG. 3 depicts assembly views of the embodiment of a weight holding device of FIG. 1.

FIGS. 2 and 3 depict the individual components of a weight holding device 100: a handgrip 10, a grip cushion 20, a strap 30, a plate cover 50 and a plate 40. Additionally FIG. 3 includes successive views (a) through (f) that depict the results of intermediate steps of an embodiment of an assembly process of the embodiment of a weight holding device 100 depicted in FIG. 1. View (a) depicts a grip cushion 20 installed over a handgrip 10; view (b) depicts a strap 30 running through a handgrip 10; view (c) depicts the two ends 33 and 34 of strap 30 overlapped and sewn together; view (d) depicts a plate 40 about the placed over the overlapped and sewn portion of strap 30; view (e) depicts plate 40 in position over the overlapped and sewn portion of strap 30 and a plate cover 50 about to be placed over plate 40; view (f) depicts an assembled weight holding device 100 with plate cover 50 sewn in position over plate 40. It should be noted that the strap 30 can be moved easily by a user through the handgrip 10, therefore the handgrip 10 can be positioned as needed relative to the plate 40 that is sewn into the strap 30. Thus, the position of a handgrip 10 relative to a plate 40 may be adjusted by a person. In the embodiment of a weight holding device 100 that is depicted in FIGS. 1-4H and 8A-11C, this adjustment is easily accomplished by sliding the handgrip 10 along the strap 30 to a desired position.

One skilled in the art understands that in other embodiments, alternate forms of a strap-separating component other than a flat, rectangular plate may be used.

Figure 4A:
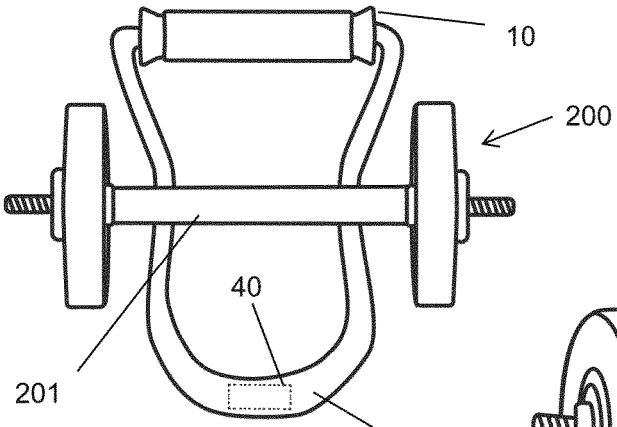
FIGS. 4A-4H depict views of the embodiment of a weight holding device of FIG. 1 being attached to a dumbbell.
Figure 4B:
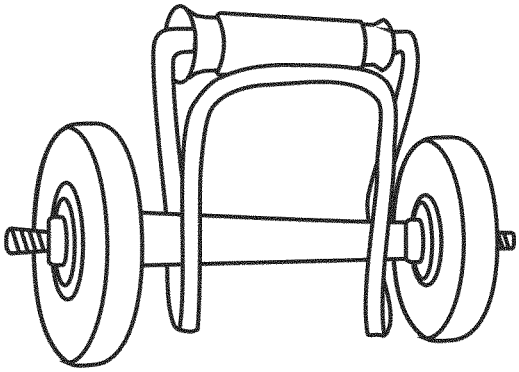
Figure 4C:
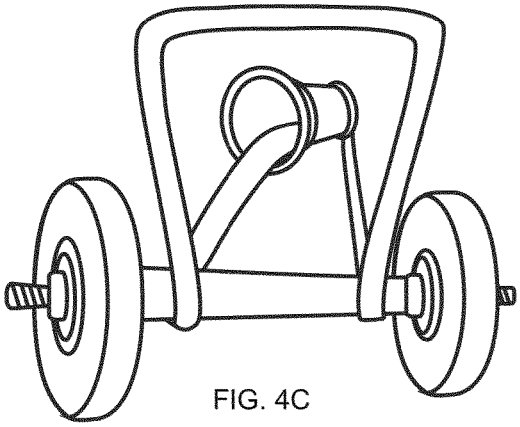
Figure 4D:
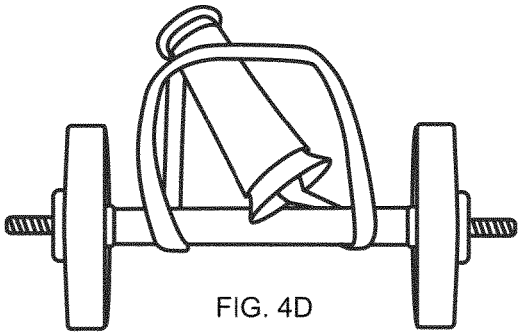
Figure 4E:
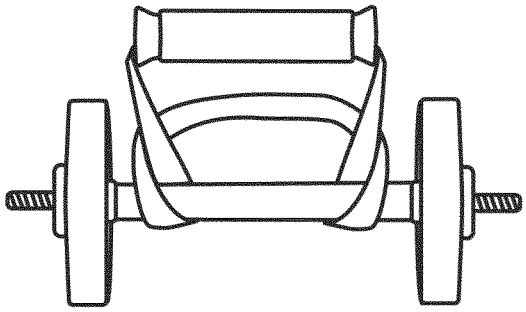
Figure 4F:
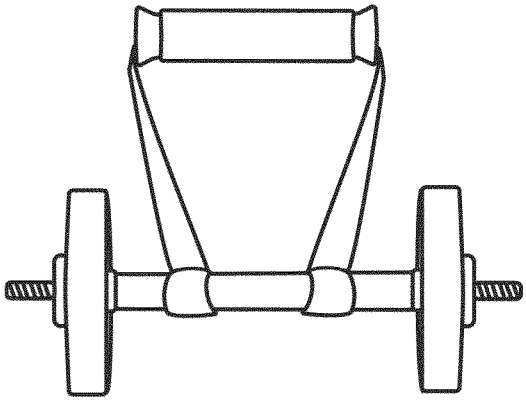
Figure 4G:
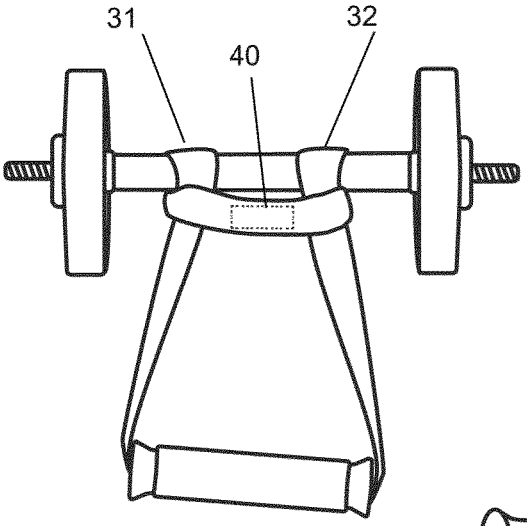
Figure 4H:
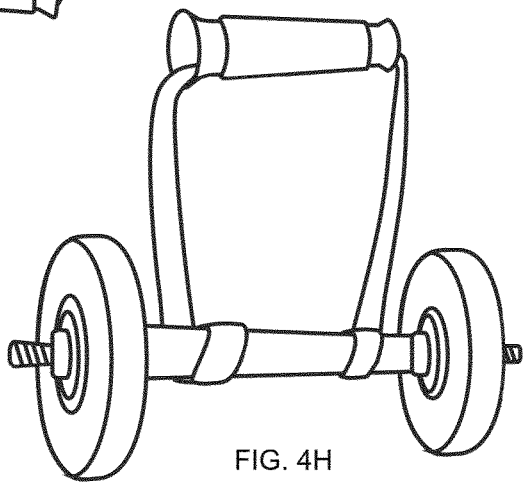

FIGS. 4A-4H depict successive views of attaching a weight holding device 100 to a dumbbell 200. For simplicity, the person that moves the weight holding device 100 through the successive views is omitted. In FIG. 4A, the handgrip 10 is positioned opposite the plate 40, the strap 30 is held behind the bar 201 of the dumbbell 200, with the strap 30 suspended from the handgrip 10. In FIG. 4B the lowest portion of strap 30 is raised. In FIGS. 4C-4E, the handgrip 10 is brought through the raised portion of the strap 30. In FIG. 4F, the handgrip 10 is pulled upwards so that the strap 30 tightens around the bar 201 of the dumbbell 200. FIG. 4G depicts the handgrip 10 rotated forward to show the position of the plate 40 in between and maintaining a separation between the aforementioned two portions of the strap 30 that will suspend the weight. Finally, FIG. 4H depicts the handgrip 10 in an upward position so that the dumbbell 200 is suspended in a horizontal orientation by the weight holding device 100.

Alternatively, the handgrip 10 can be positioned so that it is not opposite to the plate 40. In such a confirmation, there will be a single suspension point between the strap 30 and the dumbbell 200, which will cause the dumbbell to hang in a vertical, rather than a horizontal orientation. A weight suspended in such a vertical orientation may be warranted and advantageous for certain exercises, and in addition, can provide a useful variation of the stimulation of an athlete's muscles due to the greater degree of freedom of movement that a weight will exhibit in such an orientation.

Figure 11A:
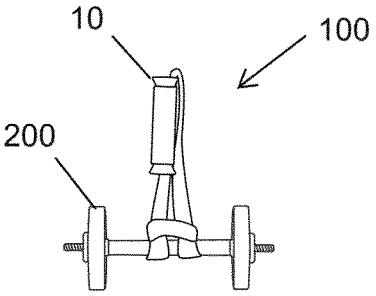
FIGS. 11A-11C depict views of the embodiment of a weight holding device of FIG. 1 being attached to a dumbbell.
Figure 11B:
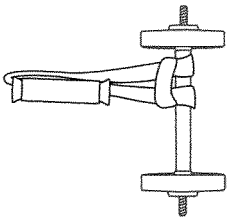
Figure 11C:
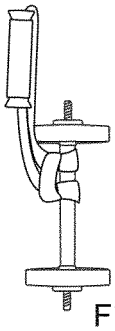

FIGS. 11A-11C depict successive views of attaching a weight holding device 100 to a dumbbell 200 where the plate 40 (not shown) is not positioned opposite to the handgrip 10. For simplicity, the person that moves the weight holding device 100 through the successive views is omitted. In FIG. 11A, the weight holding device 100 has been attached similarly to as shown in FIGS. 4A-4H and described above, however, the plate 40 (not shown) is not positioned opposite to the handgrip 10. In FIG. 11B the dumbbell 200 is moved to a vertical orientation. Finally, FIG. 11C depicts the handgrip 10 in an upward position so that the dumbbell 200 is suspended in a vertical orientation by the weight holding device 100.

Figure 5A:
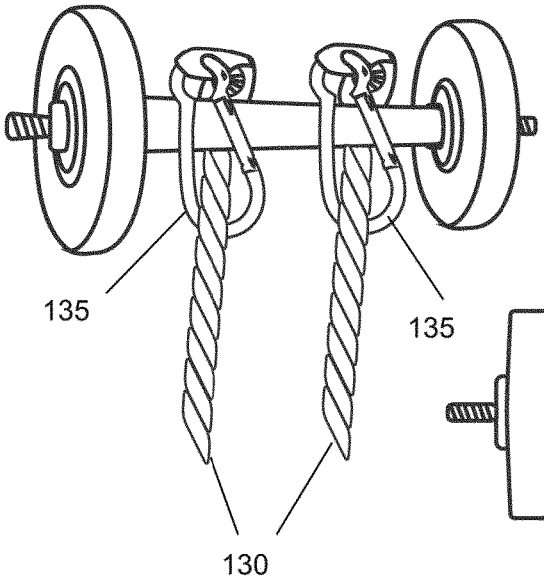
FIGS. 5A-5B depict views of a second embodiment of a weight holding device in accordance with principles of the present invention.
Figure 5B:
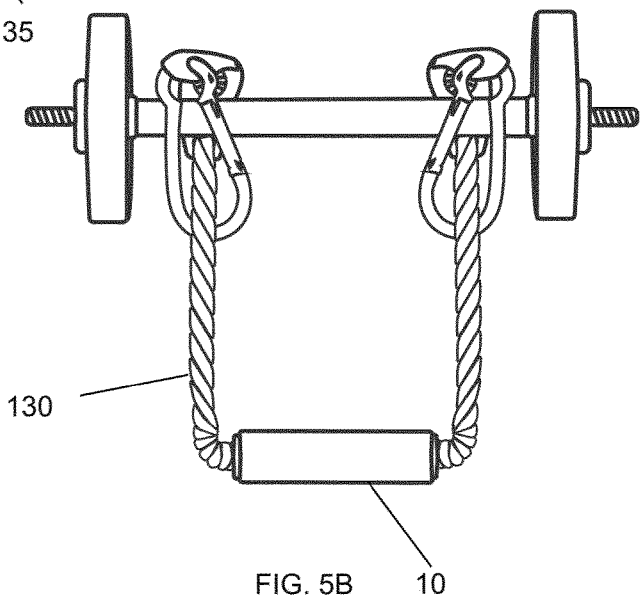

FIGS. 5A and 5B depict an alternate embodiment of a weight holding device 100. This embodiment differs from the embodiment of FIG. 1 in that the strap 30 is replaced by a rope 130 of which the two ends are not attached together, but instead a carabiner 135 is attached to each end of the rope 130. The carabiners 135 are used to attach the weight holding device 100 to a weight, e.g., a dumbbell 200 as depicted in FIGS. 5A and 5B, with a separation between the carabiners 135, thus providing the aforementioned advantage of two separate suspension points that are provided by the plate 40 in the embodiment depicted in FIG. 1. In alternate embodiments, instead of carabiners 135, a different type of component, such as a hook, may be used to attach the weight holding device 100 to a weight. Also in other embodiments, a strip of nylon sports webbing or other durable material or fabric with strength sufficient to support an exercise weight, such as used for the strap 30 in the embodiment depicted in FIG. 1, may be used in place of the rope 130.

Figure 6A:
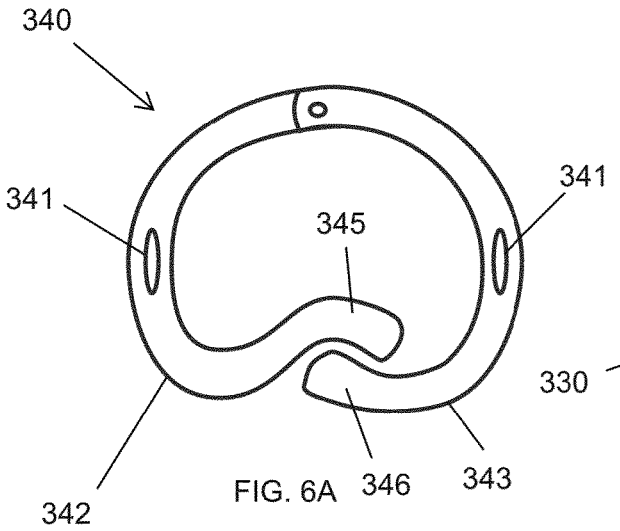
FIGS. 6A-6C depict views of a third embodiment of a weight holding device in accordance with principles of the present invention.
Figure 6B:
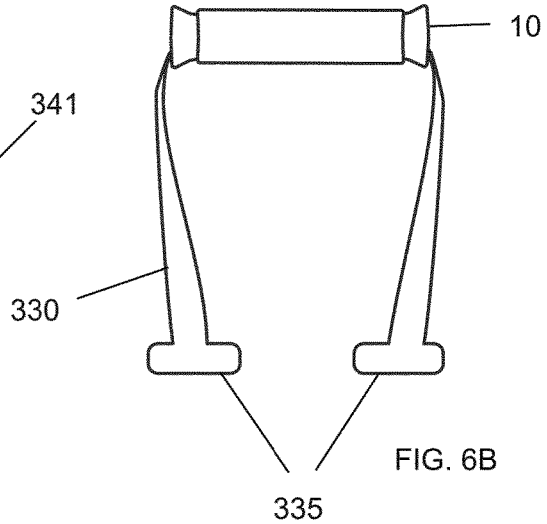
Figure 6C:
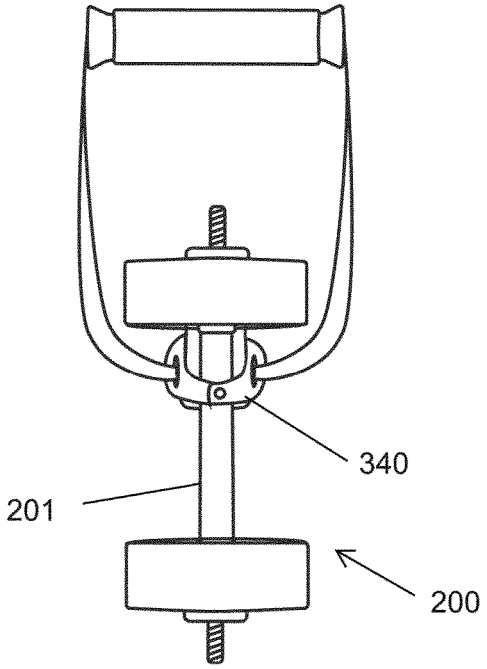

FIGS. 6A-6C depict an alternate embodiment of a weight holding device 100.

This embodiment differs from the embodiment of FIG. 1 in that the ends of the strap 330 are not sewn together, but instead have tabs 335. The tabs 335 are inserted into the slots 341 of clamp 340. The tabs 335 may be made of rubber or similar material, or may be constructed of rolled-up nylon sports webbing. Alternatively, the tabs 335 may be constructed of other materials so long as they are of a material and shape that permits them to be inserted into the slots 341, typically by a manufacturing process that requires special tooling that is able to provide enough insertion force, and that inhibits their withdrawal from the slots 341 without similarly adequate force.

To attach this embodiment of a weight holding device 100 to a weight, e.g., the dumbbell 200 depicted in FIG. 6C, the clamp 340 is placed around the bar 201 of the dumbbell 200, and then locked in a closed position as depicted in FIG. 6C. A clamp 340 is comprised of two sections 342 and 343 that are connected with a small pin 344 that allows the two sections 342 and 343 to rotate with respect to each other, thus moving the clamp 340 between open and closes positions. The two respective ends 345 and 346 of sections 342 and 343 can interlock when the two ends 345 and 346 are closed together. One skilled in the art will recognize that other arrangements of providing a mechanism for clamping around a dumbbell 200 are possible, so long as the clamping apparatus is attachable to a dumbbell 200 and capable of supporting the dumbbell 200 when suspended. This embodiment of a weight holding device 100 allows the weight, e.g., the dumbbell 200 depicted in FIG. 6C, to be suspended in a vertical orientation. A clamp 340 may be made of steel or other material that is strong enough to suspend a weight.

Figure 7A:
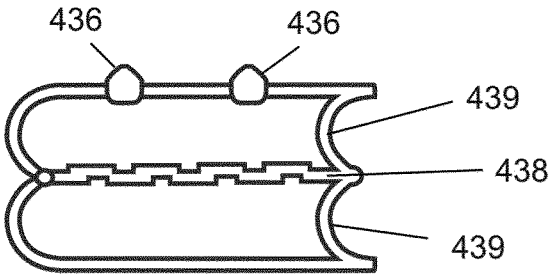
FIGS. 7A-7C depict views of a fourth embodiment of a weight holding device in accordance with principles of the present invention.
Figure 7B:
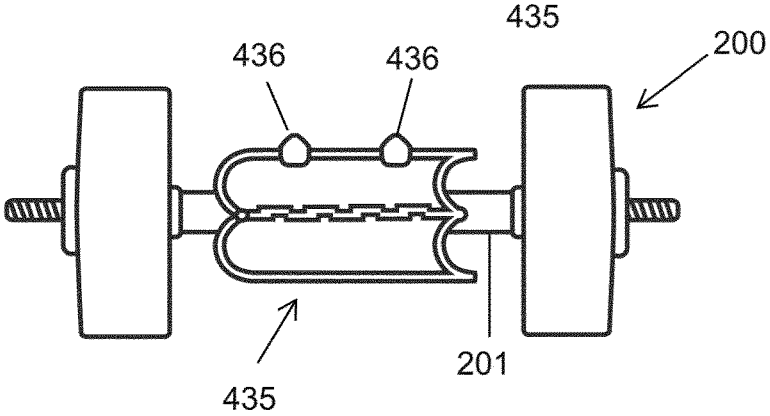
Figure 7C:
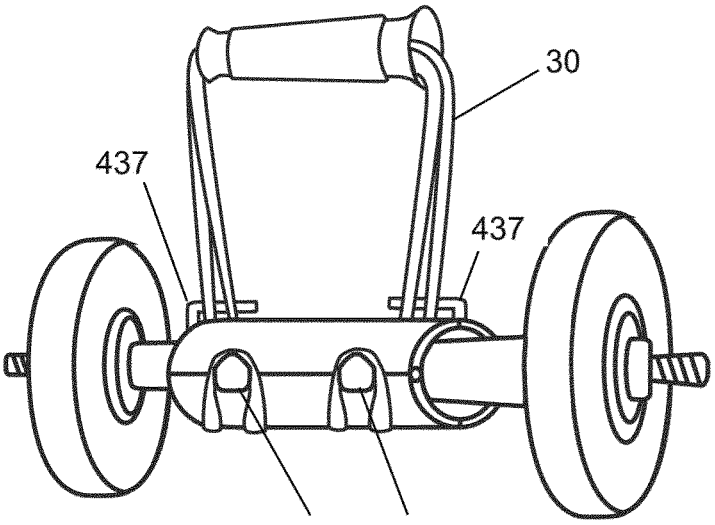

FIGS. 7A-7C depict an alternate embodiment of a weight holding device 100. This embodiment differs from the embodiment of FIG. 1 in that it does not include a plate 40 and the strap 30 is routed differently, such that the strap 30 is not captured by the handgrip 10, but rather it is inserted freely through the handgrip 10 as shown, and that it further includes a strap-separating component in the form of a substantially cylindrical sheath 435, which comprises two sections 439 joined by a hinge 438, two hooks 436 attached to one section 439 and two brackets 437 attached to one of the two sections 439. A sheath 435 may be made of steel, aluminum or other suitable material. The brackets 437 are omitted from FIGS. 7A and 7B for simplicity, but are shown in FIG. 7C.

To attach this embodiment of a weight holding device 100 to a weight, e.g., the dumbbell 200 depicted in FIGS. 7A-7C, the sheath 435 is placed around the bar 201 of the dumbbell 200 in order to enclose the bar 201, and then locked in a closed position as depicted in FIG. 7C. Then the strap 30 is placed over the hooks 436 and routed behind the brackets 437 as depicted in FIG. 7C. The separation between the hooks 436 provides the aforementioned advantage of two separate suspension points that are provided by the plate 40 in the embodiment depicted in FIG. 1 and by the two carabiners 135 in the embodiment depicted in FIGS. 5A and 5B.

Figure 8A:
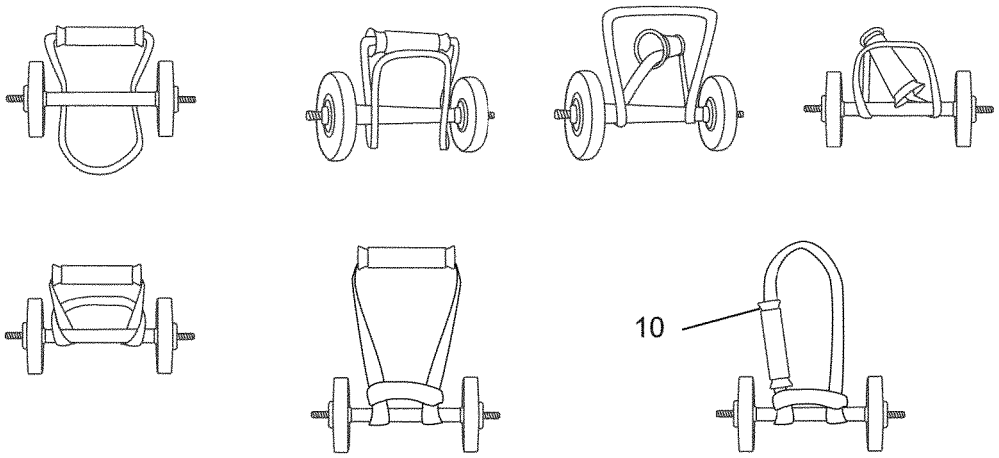
FIGS. 8A-8C depict views of two of the embodiments of a weight holding device of FIG. 1 being attached to a bar.
Figure 8B:
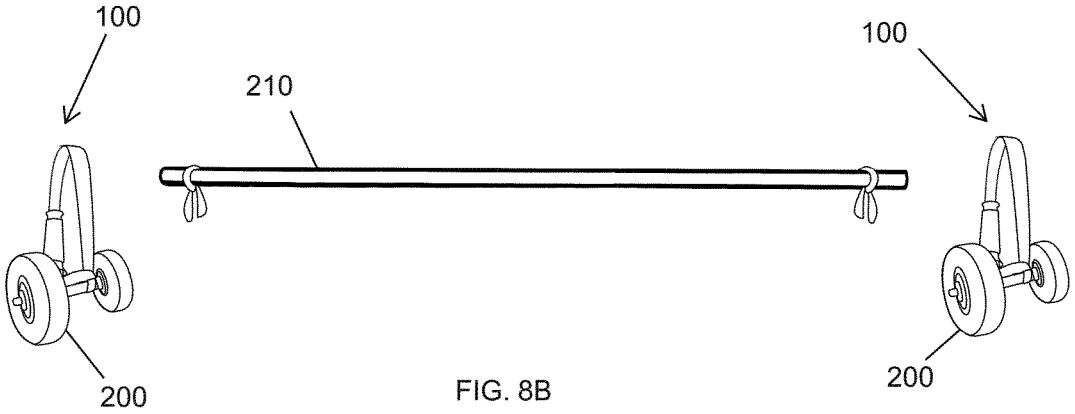
Figure 8C:
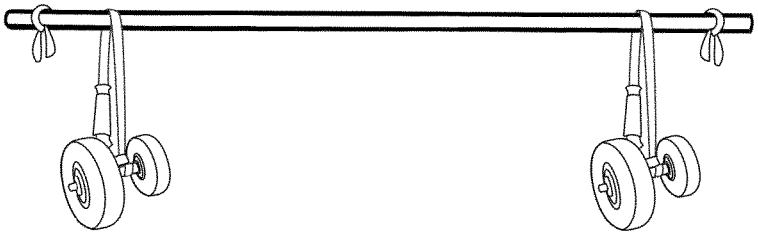
Figure 9A:
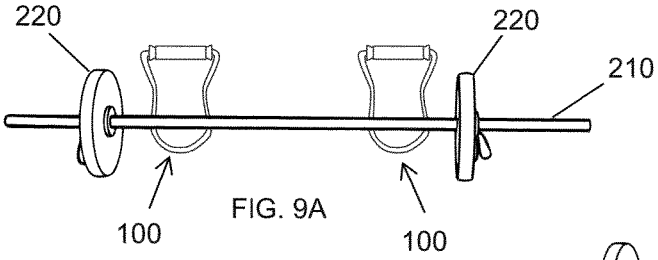
FIGS. 9A-9F depict views of two of the embodiments of a weight holding device of FIG. 1 being attached to a bar with weight plates.
Figure 9B:
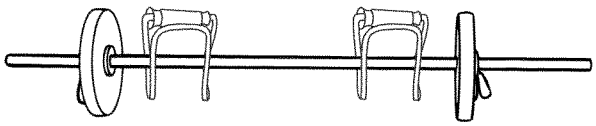
Figure 9C:
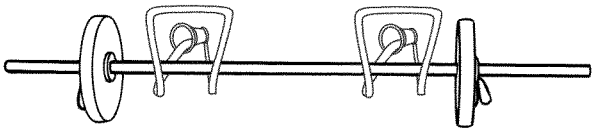
Figure 9D:
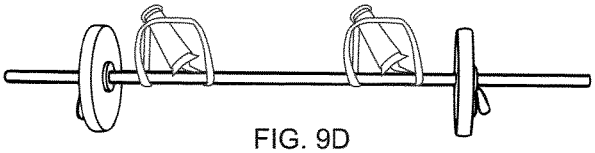
Figure 9E:
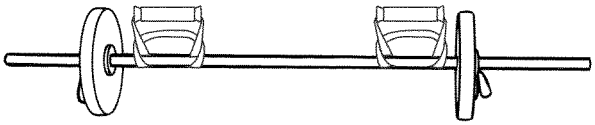
Figure 9F:
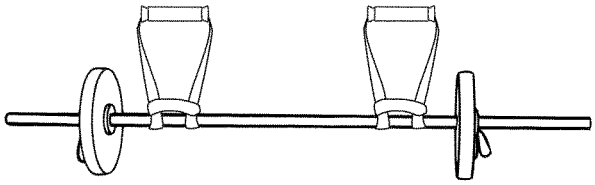
Figure 10A:
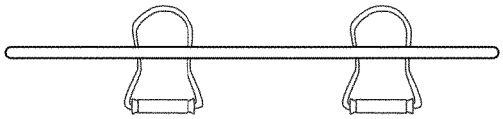
FIGS. 10A-10F depict views of two of the embodiments of a weight holding device of FIG. 1 being attached to an overhead bar.
Figure 10B:
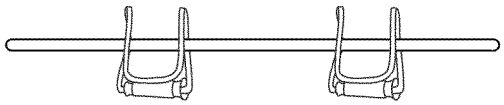
Figure 10C:
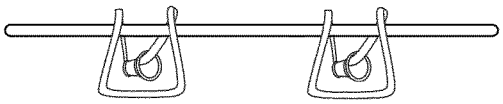
Figure 10D:
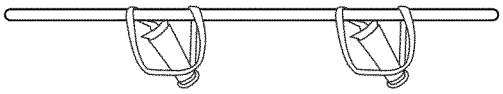
Figure 10E:
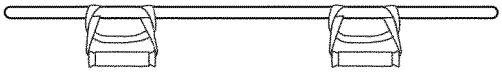
Figure 10F:
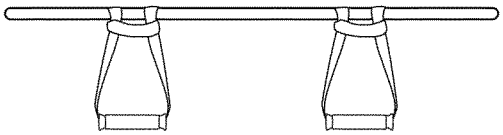

FIGS. 8A-8C depict an alternate method of attaching the embodiment of a weight holding device 100 as depicted in FIG. 1 to a weight, e.g., a dumbbell 200. In this method, the weight holding device 100 is attached to a dumbbell 200 as depicted in FIGS. 4A-4H and as described above, and then the handgrip 10 is slid down away from the upmost portion of the strap 30, thus making it possible to suspend the weight holding device 100 from a bar 210, as opposed to being held (via the handgrip 10) by a person. As depicted in FIGS. 8B and 8C, two such configured weight holding devices 100 are used to suspend two dumbbells 200 from a bar 210.

FIGS. 9A-9F depict a method of attaching two weight holding devices 100 to a bar 210 with two attached weight plates 220. FIGS. 10A-10F depict a method of attaching two weight holding devices 100 to an overhead bar 210.

Figure 30:
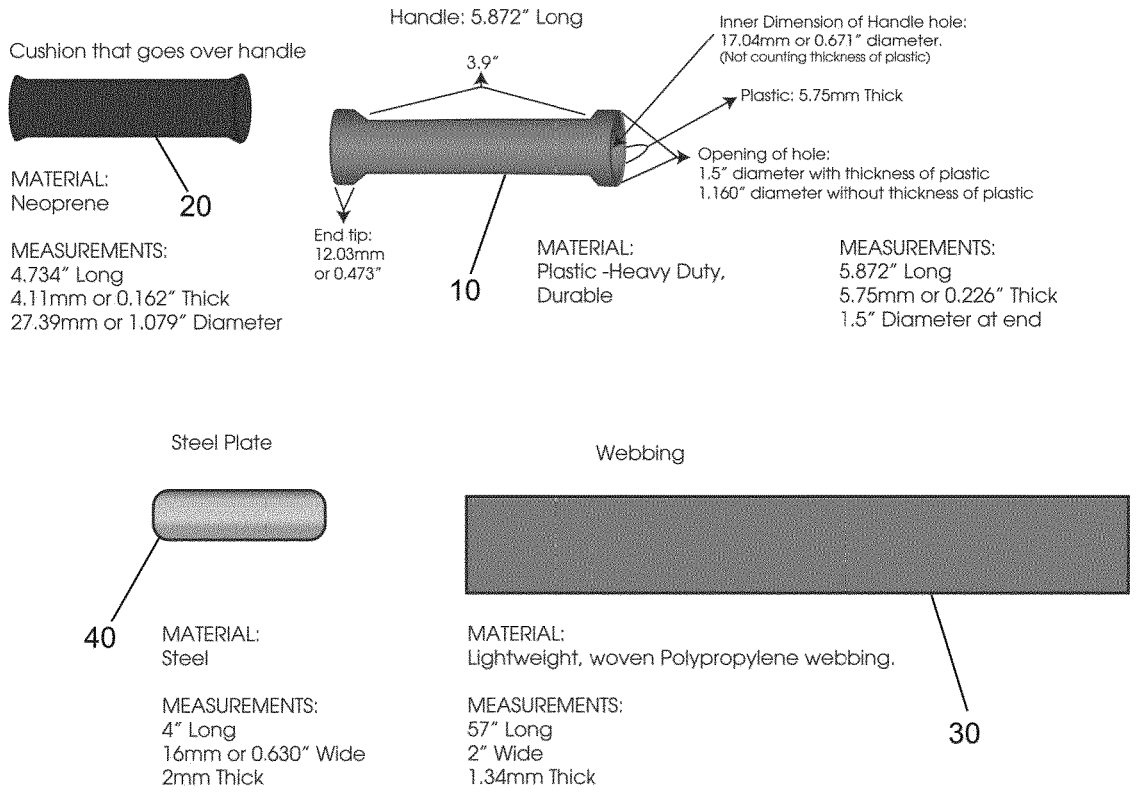
FIG. 30 depicts individual components of a fifth embodiment of a weight holding device.

FIG. 30 depicts individual components of an alternate embodiment of a weight holding device 100: a handgrip 10, a grip cushion 20, a strap 30 and a plate 40. A grip cushion 20 is comprised of neoprene material and has the following dimensions: 4.734 inches in length, 0.162 inches thick and 1.079 inches in diameter. A handgrip 10 (referred to in the figure as a "handle") is comprised a heavy-duty, durable plastic with a length of 5.872 inches, a thickness of 5.75 millimeters and has a main section with a length of 3.9", two end tips on each end of the main section, each with a length of 0.473 inches. The inner and outer diameters of the opening at each end of the handgrip 10 is 0.671 inches and 1.5 inches, respectively. A plate 40 is comprised of steel, and has the following dimensions: 4 inches in length, 0.630 inches in width, and 2 millimeters in thickness. A strap 30 is comprised of lightweight, woven, polypropylene webbing material and has the following dimensions: 57 inches in length, 2 inches in width, and 1.34 millimeters in thickness.

Figure 31:
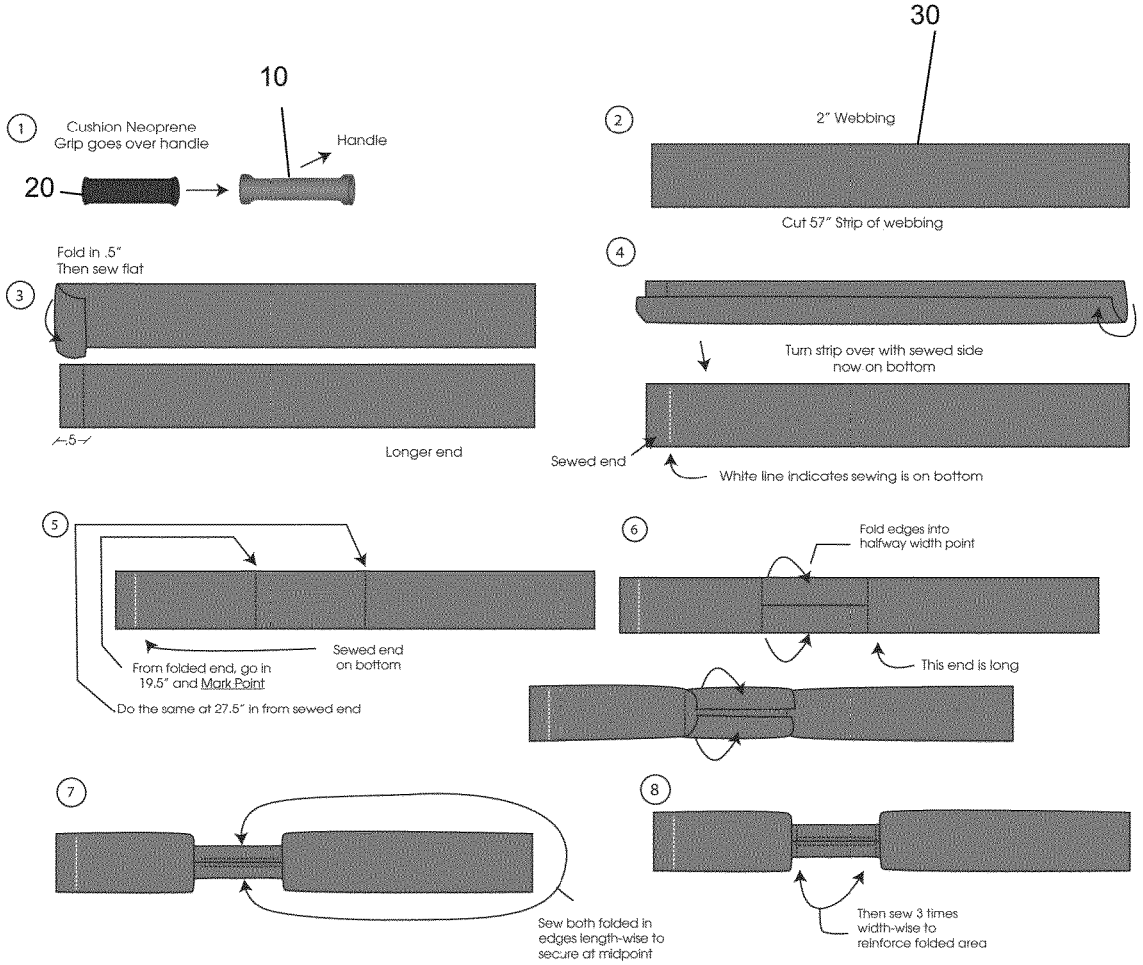
FIGS. 31-33 depict assembly views of the embodiment of a weight holding device of FIG. 30.
Figure 32:
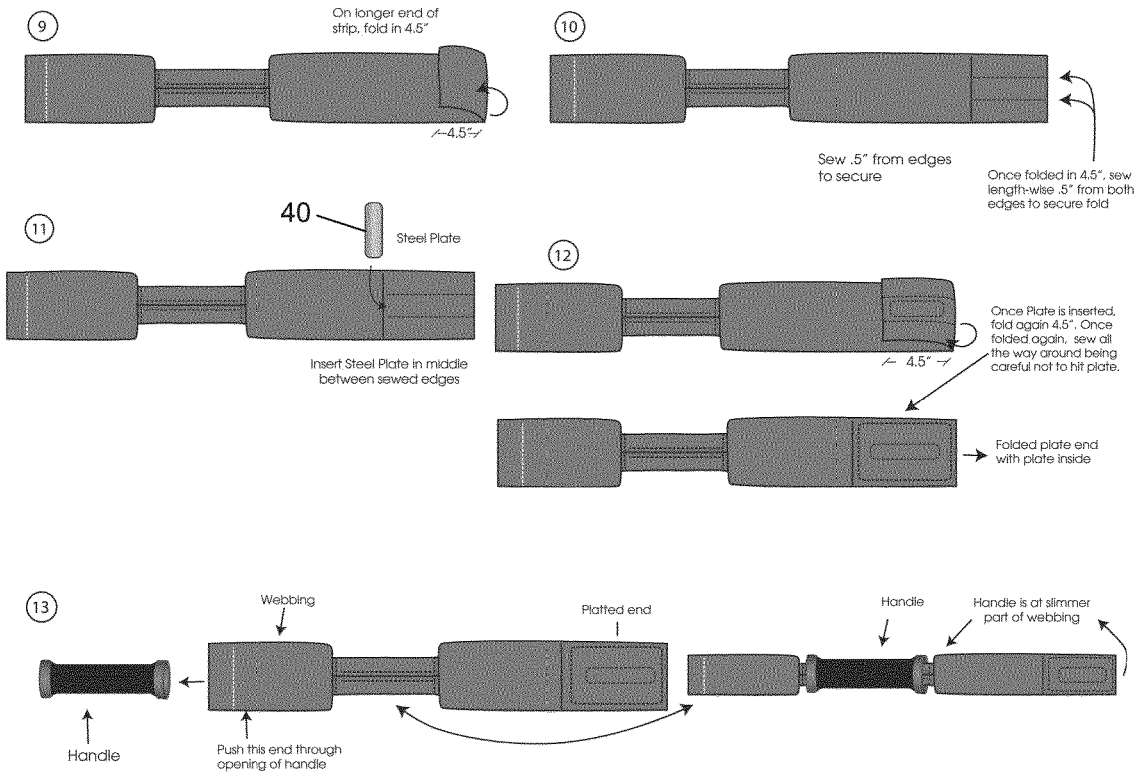
Figure 33:
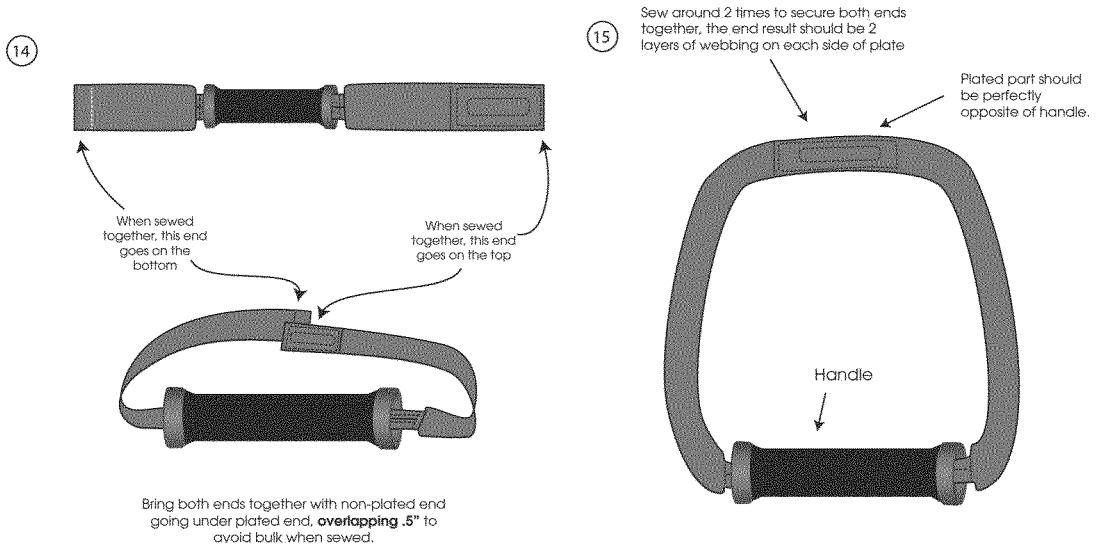

FIGS. 31-33 depict successive views (1) through (15) that depict the results of intermediate steps of an embodiment of an assembly process of the embodiment of a weight holding device 100 that is depicted in FIG. 30. View (1) depicts a grip cushion 20 installed over a handgrip 10 ("handle"); view (2) depicts a strap 30 (referred to in the figure as a "strip") of width 2 inches that has been cut to a length of 57 inches, if not already that length; view (3) depicts one end of strap 30 folded in 0.5 inches and then sewn flat; view (4) depicts turning the strap 30 over with the sewed side on the bottom; view (5) depicts marking points that are 19.5 inches and 27.5 inches from the folded end, respectively; view (6) depicts folding the edges between the two marked points into a halfway width point; view (7) depicts sewing both folded in edges lengthwise to secure them at the midpoint; view (8) depicts sewing the folded area three times widthwise to reinforce the folded area; view (9) depicts the other end of strap 30 folded in 4.5 inches; view (1) depicts sewing the folded in portion lengthwise 0.5 inch from each edge in order to secure the fold; view (11) depicts inserting plate 40 in the middle between the sewed edges; view (12) depicts folding the end of the strap with plate 40 again by 4.5 inches, and then sewing the folded portion all the way around to secure the plate 40 inside; view (13) depicts pushing one end of strap 30 through the handgrip 10 so that it ends up being disposed around the folded and sewn, slimmer middle section; view (14) depicts sewing the two ends of strap 30 together, with the section with plate 40 on the top; and view (15) depicts sewing two times around the joined ends of strap 30.

All exercises listed herein can be done in combination with one another. They can also be done in a seated position, standing position, using one leg, two legs, one arm, two arms, alternating arms or legs, or any combination of these variations.

A weight holding device 100 can also be attached to both ends of a bar, pole, or rod to perform the exercises listed herein and any exercises that can be performed with a weighted bar.

A weight holding device 100 can also be attached as a lifting mechanism to a bar, pole, or rod, to perform the exercises listed herein.

A handgrip 10 of a weight holding device 100 can be gripped with an overhead, underhand, or vertical (hammer) grip by a user, or a combination of these grips, to perform the exercises listed herein.

Figure 12A:
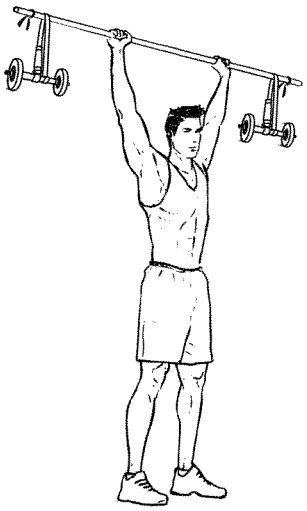
FIGS. 12A, 12B, 13A, 13B, 14A, 14B, 15A, 15B, 16A, 16B, 17A, 17B, 18A, 18B, 19A, 19B, 20A, 20B, 21A, 21B, 22A, 22B, 23A, 23B, 24A, 24B, 25A, 25B, 26A, 26B, 27A-27D, 28A, 28B, 29A and 29B depict views of a person using one or more weight holding devices to perform exercises.
Figure 12B:
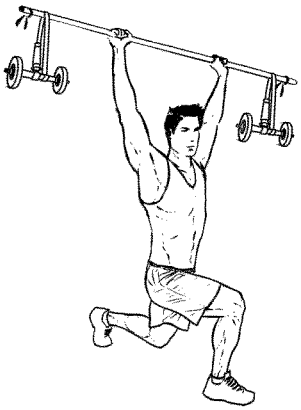

FIGS. 12A and 12B depict a person using two weight holding devices 100 as depicted in FIGS. 8A-8C and described above in use by a person to perform a bar overhead alternating lunge exercise. The bar overhead alternating lunge exercise is performed as follows: Grab bar with overhand grip. Raise bar straight overhead with arms straight. Step one foot out sending the knee into a 90° bend. Push out of bend and step back into starting position. With arms still overhead, repeat the same movement with the opposite leg. Alternate legs for desired number of repetitions. This exercise can also be done by holding bar at chin level while performing the lunges and or lunging with same foot before switching to opposite foot.

Figure 13A:
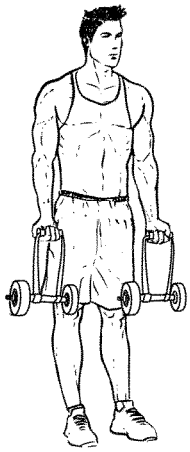
Figure 13B:
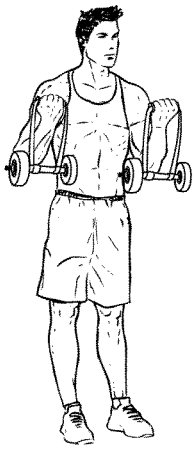

FIGS. 13A and 13B depict a person using two weight holding devices 100 as depicted in FIGS. 4A-4H and described above in use by a person to perform a biceps curl exercise. The biceps curl exercise is performed as follows: Stand with a weight holding device 100 attached to a dumbbell in each hand, arms positioned down the side of your body, both palms facing forward. Raise both weight holding devices 100 until they reach your shoulders' height and slowly lower them back down after a short pause. Repeat for desired number or repetitions.

Figure 14A:
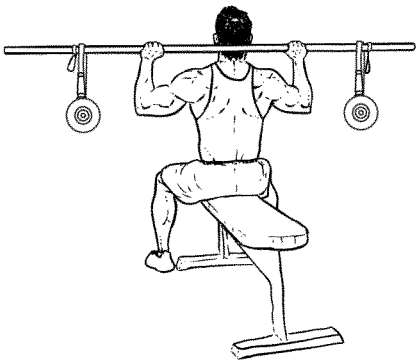
Figure 14B:
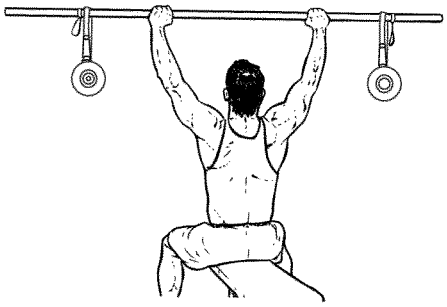

FIGS. 14A and 14B depict a person using two weight holding devices 100 as depicted in FIGS. 8A-8C and described above in use by a person to perform a seated shoulder press bar exercise. The seated shoulder press bar exercise is performed as follows: Sit on a bench and hold a bar that has two weight holding devices 100 attached to two dumbbells at shoulder level, palms facing forward. Push the bar straight up until your elbows come close to locking and lower it back down after a short pause. Repeat for desired number or repetitions.

Figure 15A:
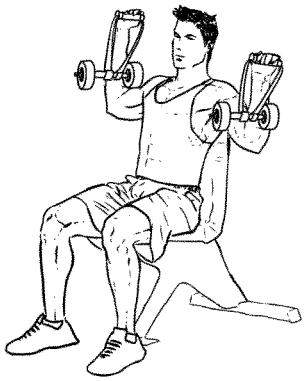
Figure 15B:
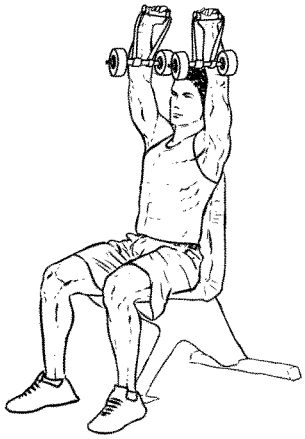

FIGS. 15A and 15B depict a person using two weight holding devices 100 as depicted in FIGS. 4A-4H and described above in use by a person to perform a seated should press exercise. The seated shoulder press exercise is performed as follows: Sit on a bench and hold a weight holding device 100 with a dumbbell attached in each hand at shoulder level, palms facing forward. Push the weight holding devices 100 straight up until your elbows come close to locking and lower them back down after a short pause. Repeat for desired number or repetitions.

Figure 16A:
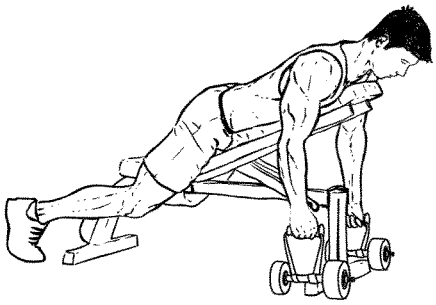
Figure 16B:
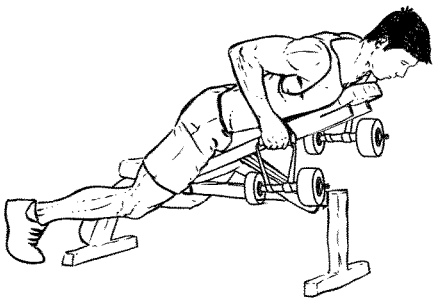

FIGS. 16A and 16B depict a person using two weight holding devices 100 as depicted in FIGS. 4A-4H and described above in use by a person to perform a prone incline bench row exercise. The prone incline bench row exercise is performed as follows: Incline a bench. Set in place two weight holding devices 100 attached to two dumbbells. Get positioned face down on the bench in a straddle position and grab the weight holding devices 100. Pull the arms back as to bring the weight holding devices 100 closer to the body. Raise to the point of a squeeze in between the shoulder blades, then lower arms back down to starting position. Repeat for desired number or repetitions. This exercise can also be done with a single arm or alternating arms.

Figure 17A:
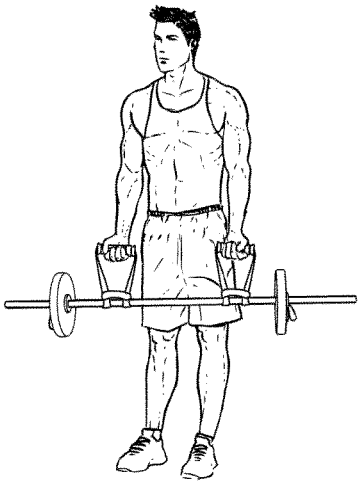
Figure 17B:
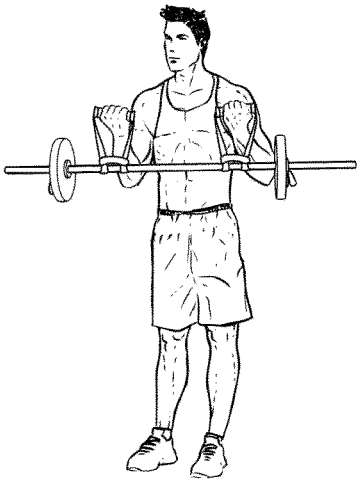

FIGS. 17A and 17B depict a person using two weight holding devices 100 as depicted in FIGS. 9A-9F and described above in use by a person to perform a device bar standing curls exercise. The device bar standing curls exercise is performed as follows: Attach two weight holding devices 100 to a weighted pole, bar, or elongated rod. Space the two weight holding devices 100 approximately shoulder width apart. Hold the two weight holding devices 100 with an underhand grip. Start with the two weight holding devices 100 in front of thighs. Proceed to bend both elbows, bringing the two weight holding devices 100 up until elbows are at about a 45° angle. Lower the two weight holding devices 100 back down to starting positions and repeat for desired number of repetitions. This exercise can also be done as preacher curls, using a preacher curl station.

Figure 18A:
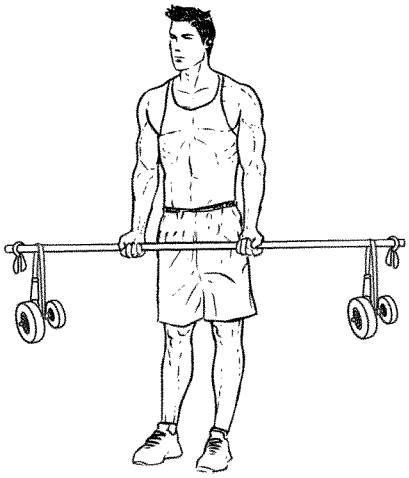
Figure 18B:
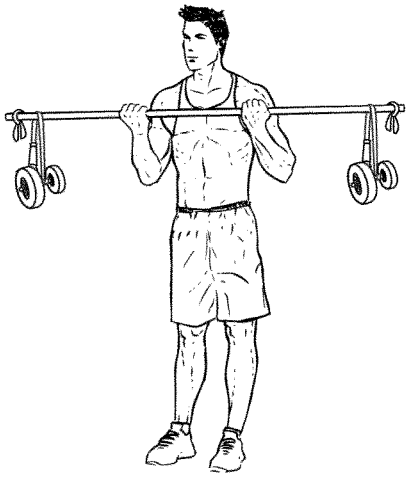

FIGS. 18A and 18B depict a person using two weight holding devices 100 as depicted in FIGS. 8A-8C and described above in use by a person to perform an alternate method of a bar standing curls exercise. The alternate method of a bar standing curls exercise is performed as follows: Attach two weight holding devices 100 to two dumbbells, respectively. Shift handles on the two weight holding devices 100 to the hanging position. Suspend the two weight holding devices 100 to a pole, bar, or elongated rod that can support the selected weight at each of its ends. Grab the bar with an underhand grip. Start with the bar in front of thighs. Proceed to bend both elbows, bringing the bar up until elbows are at about a 45° angle. Lower the bar back down to starting position and repeat for desired number of repetitions. This exercise can also be done as preacher curls, using a preacher curl station.

Figure 19A:
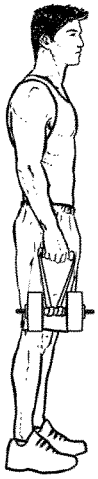
Figure 19B:
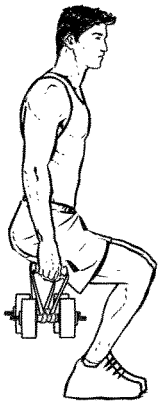

FIGS. 19A and 19B depict a person using two weight holding devices 100 as depicted in FIGS. 4A-4H and described above in use by a person to perform a squat exercise. The squat exercise is performed as follows: Stand with a weight holding device 100 attached to a dumbbell in each hand. Go into a 90° knee bend with both knees, keeping the arms to the side. Come out of the knee bend into the starting upright position. Repeat for desired number or repetitions.

Figure 20A:
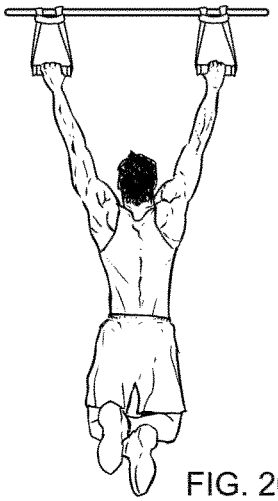
Figure 20B:
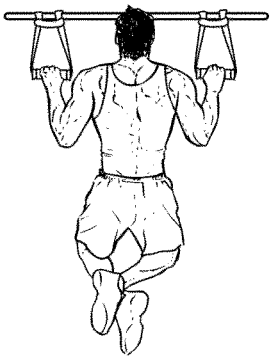

FIGS. 20A and 20B depict a person using two weight holding devices 100 attached to an overhead bar 211 as depicted in FIGS. 10A-10F in use by a person to perform an overhand pull up exercise. The overhand pull up exercise is performed as follows: Attach the weight holding devices 100 to an overhead bar, or any structure that can support proper body weight. Make sure the handgrips 10 hang and are accessible for gripping. Apply body weight by gripping handgrips 10 with an overhand grip and lifting weight off the ground by bending the elbows to come up to desired height. Lower the body back down to the starting position and repeat for desired number of repetitions. This exercise can also be done while keeping any portion of the body in contact with the ground.

Figure 21A:
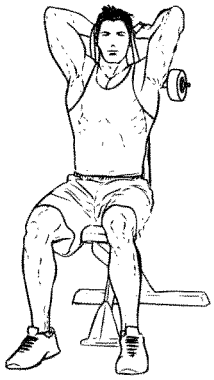
Figure 21B:
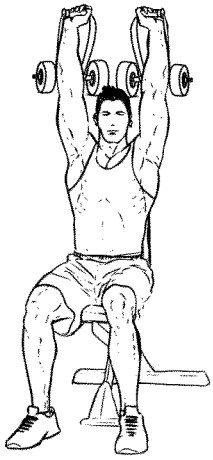

FIGS. 21A and 21B depict a person using two weight holding devices 100 as depicted in FIGS. 4A-4H and described above in use by a person to perform a seated overhead triceps extension exercise. The seated overhead triceps extension exercise is performed as follows: Sit down and hold a weight holding device 100 with a dumbbell attached in each hand. Place both hands behind your head, elbows at 90 degree angles, upper arms straight up. Raise the weight holding devices 100 with both hands until your arms are close to being fully extended and slowly lower them back after a short pause. Repeat until the desired number of repetitions are reached. This exercise can also be done with one arm or alternating arms.

Figure 22A:
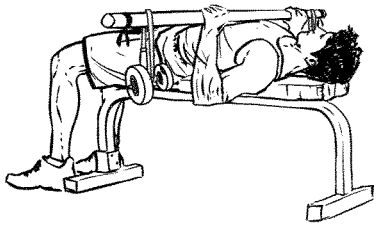
Figure 22B:
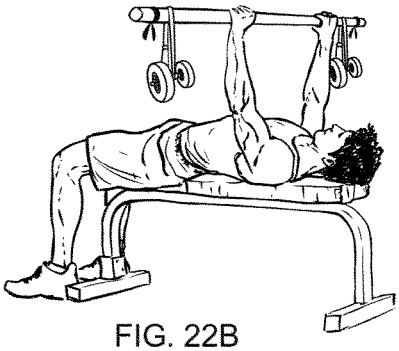

FIGS. 22A and 22B depict a person using two weight holding devices 100 as depicted in FIGS. 8A-8C and described above in use by a person to perform a bench press exercise. The bench press exercise is performed as follows: Lie down on your back on a bench with a bar that has two weight holding devices 100 attached to two dumbbells at chest level along your body, palms facing your feet. Raise the bar straight up until your elbows are close to being locked and lower it back slowly after a short pause. Repeat until the desired number of repetitions are reached.

Figure 23A:
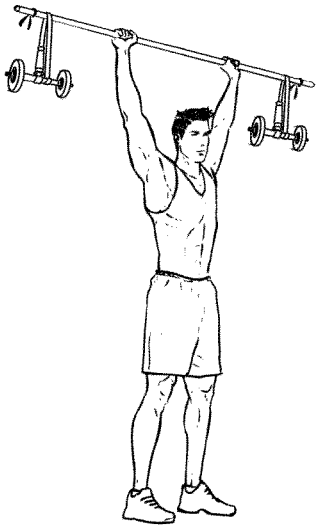
Figure 23B:
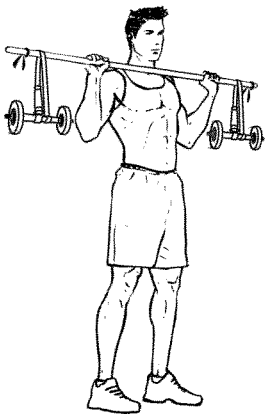

FIGS. 23A and 23B depict a person using two weight holding devices 100 as depicted in FIGS. 8A-8C and described above in use by a person to perform a bar shoulder press exercise. The bar shoulder press exercise is performed as follows: Hold a bar that has two weight holding devices 100 attached to two dumbbells with an overhead grip. Lift bar overhead while standing until arms are almost straight. Bend elbows bringing the bar down to about eye level. Press bar over head to starting position, then repeat for desired number of repetitions. This exercise can also be done in a seated position.

Figure 24A:
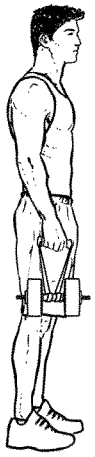
Figure 24B:
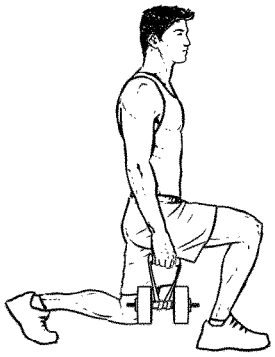

FIGS. 24A and 24B depict a person using two weight holding devices 100 as depicted in FIGS. 4A-4H and described above in use by a person to perform a walking lunge exercise. The walking lunge exercise is performed as follows: Stand with a weight holding device 100 attached to a dumbbell in each hand. Step one foot forward going into a 90° knee bend. Pushing off your back leg, push forward to an upright position for a complete step. Repeat with the opposite leg. Proceed across a wide area or space.

Figure 25A:
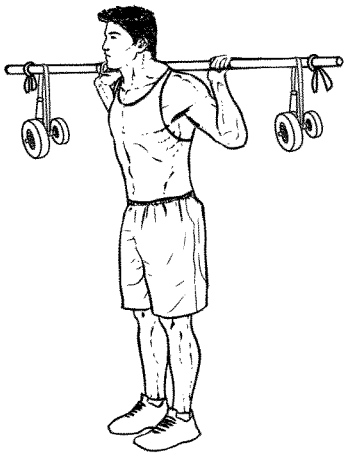
Figure 25B:
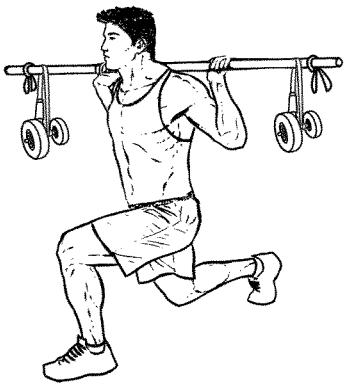

FIGS. 25A and 25B depict a person using two weight holding devices 100 as depicted in FIGS. 8A-8C and described above in use by a person to perform a bar alternating lunge exercise. Attach two weight holding devices 100 to two dumbbells, respectively. Shift handles on the two weight holding devices 100 to the hanging position. Attach the two weight holding devices 100 to a pole, bar, or elongated rod that can support the selected weight at each of its ends. With an overhand grip, load the bar onto your shoulders. Step one foot out sending the knee into a 90° bend. Push out of the bend and step back into the starting position. Repeat the same movement with the opposite leg. Alternate legs for desired number of repetitions. This exercise can also be done by holding the bar at chin level while performing the lunges and or lunging with the same foot before switching to the opposite foot.

Figure 26A:
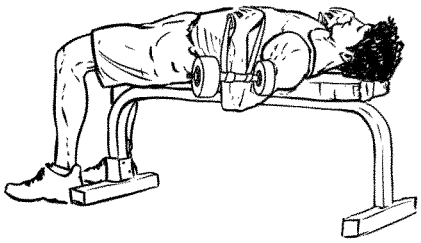
Figure 26B:
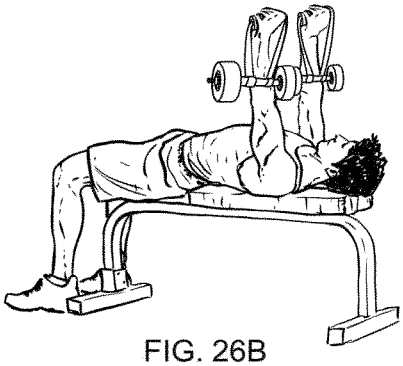

FIGS. 26A and 26B depict a person using two weight holding devices 100 as depicted in FIGS. 4A-4H and described above in use by a person to perform a bench press exercise. The bench press exercise is performed as follows: Lie down on your back on a bench with a weight holding device 100 attached to a dumbbell in each hand at chest level along your body, palms facing your feet. Raise the weight holding devices 100 straight up until your elbows are close to being locked and lower them back slowly after a short pause. Repeat until the desired number of repetitions are reached. This exercise can also be done with a single arm or alternating arms.

Figure 27A:
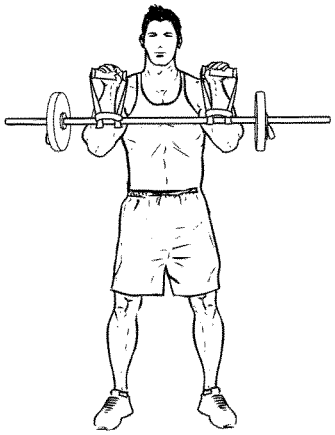
Figure 27B:
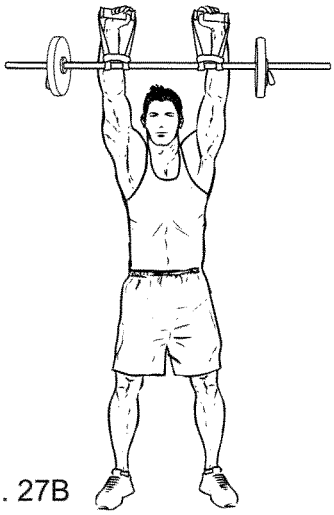

FIGS. 27A-27B depict a person using two weight holding devices 100 as depicted in FIGS. 9A-9F and described above in use by a person to perform a bar front shoulder press exercise. The bar front shoulder press exercise is performed as follows: Attach two weight holding devices 100 to a weighted pole, bar, or elongated rod. Space the two weight holding devices 100 approximately shoulder width apart. Grab the two weight holding devices 100 with an overhead grip. Lift the two weight holding devices 100 overhead while standing and keeping in front of the arms, until arms are almost straight. Bend elbows bringing the two weight holding devices 100 down to about eye level. Press the two weight holding devices 100 over head to starting position then repeat for desired number of repetitions. This exercise can also be done in a seated position.

Figure 27C:
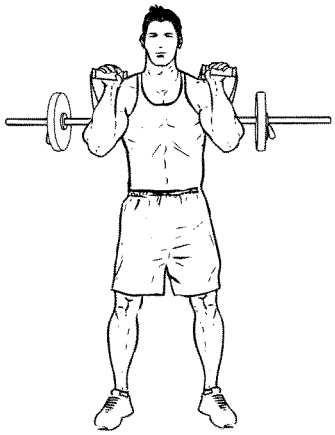
Figure 27D:
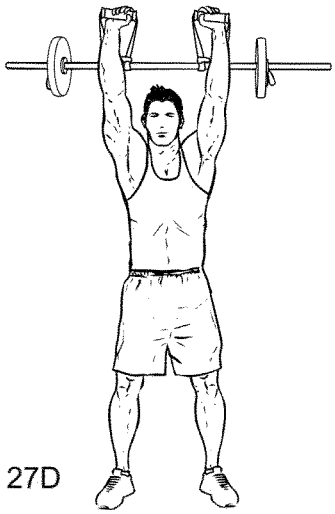

FIGS. 27C-27D depict a person using two weight holding devices 100 as depicted in FIGS. 9A-9F and described above in use by a person to perform a bar rear shoulder press exercise. The bar rear shoulder press exercise is performed as follows: Attach two weight holding devices 100 to a weighted pole, bar, or elongated rod. Space the two weight holding devices 100 approximately shoulder width apart. Grab the two weight holding devices 100 with an overhead grip. Lift the two weight holding devices 100 overhead while standing and keeping to rear of the arms, until arms are almost straight. Bend elbows bringing the two weight holding devices 100 down to about eye level. Press the two weight holding devices 100 over head to starting position then repeat for desired number of repetitions. This exercise can also be done in a seated position.

Figure 28A:
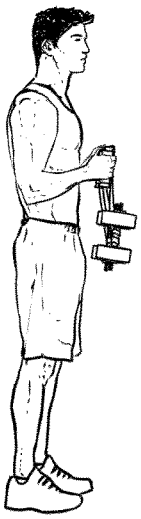
Figure 28B:
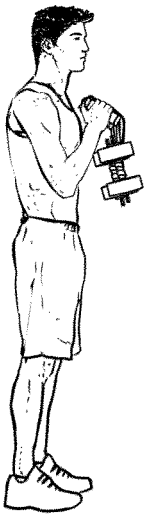

FIGS. 28A and 28B depict a person using two weight holding devices 100 with dumbbells in vertical orientation as depicted in FIG. 11C and described above in use by a person to perform a hammer curl exercise. The hammer curl exercise is performed as follows: Stand with a weight holding device 100 attached to a dumbbell in each hand, arms positioned along the sides of your body, palms facing your body. Raise both a weight holding devices 100 by curling your elbows and lower them down after a short pause. This exercise can also be done with a single arm or alternating arms.

Figure 29A:
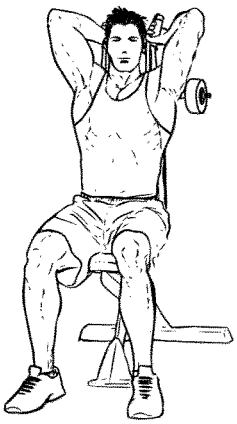
Figure 29B:
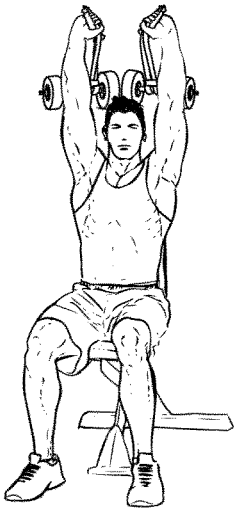

FIGS. 29A and 29B depict a person using two weight holding devices 100 as depicted in FIGS. 4A-4H and described above in use by a person to perform a seated overhead triceps extension exercise. The seated overhead triceps extension exercise is performed as follows: Sit down and hold two weight holding devices 100, each with a dumbbell attached, with both hands behind your head, elbows at 90 degree angles, upper arms straight up. Raise the weight holding devices 100 with both hands until your arms are close to being fully extended and slowly lower them back after a short pause. Repeat until the desired number of repetitions are reached. This exercise can also be done with one arm or alternating arms.

The following additional exercises can be performed with one or more weight holding devices 100. Other exercises, not depicted or described herein, may also be performed with one or more weight holding devices 100.

Abdominals

Dumbbell Side Bend

Hold a weight holding device 100 attached to a dumbbell with one hand along the side of your body. Tilt your upper body to the side that holds the dumbbell and bring it back after a short pause. Complete your set and change sides.

Bench Crunches

Lie down on a bench with a weight holding device 100 attached to a dumbbell in each hand. Take arms straight up towards ceiling with elbows straight. Keeping the elbows straight, go into a crunch as if to touch the ceiling with the weight holding devices 100. Lower the shoulders back down to the bench and repeat for a complete set.

Push-Up Position Airlift

Attach a weight holding device 100 to a dumbbell. Get into a push-up position with dumbbell close to active hand. Keeping the nonactive hand on the floor, raise the weight holding device 100 straight up towards the ceiling with active hand. Once arm and elbow are fully straight lower the weight holding device 100 back down to starting position. Repeat for desired number of repetitions then switch sides.

Chest

Incline Bench Press

Attach two weight holding devices 100 to two dumbbells. Lie down on your back on an inclined bench and hold a weight holding device 100 at chest level along your body, palms facing forward. Raise the weight holding devices 100 straight up until your elbows are close to being locked and lower them back slowly after a short pause. Repeat until the desired number of repetitions are reached (This exercise can be done with one arm or alternating arms also).

Decline Bench Press

Attach two weight holding devices 100 to two dumbbells. Lie down on your back on a decline bench and hold a weight holding device 100 at chest level, palms facing forward. Raise the weight holding device 100 straight up until your elbows are close to being locked and lower them back slowly after a short pause. Repeat until the desired number of repetitions are reached (This exercise can be done with one arm or alternating arms also).

Lying Fly

Attach two weight holding devices 100 to two dumbbells. Lie down on your back on the bench and hold a weight holding device 100 at body height, elbows just slightly arched. Raise the weight holding device 100 until they are side by side on top of you and slowly lower them back after a short pause.

Incline Fly

Attach two weight holding devices 100 to two dumbbells. Lie down on your back on an incline bench and hold a weight holding device 100 at body height, elbows just slightly arched. Raise the weight holding device 100 until they are side by side on top of you and slowly lower them back after a short pause.

Straight-Arm Pullover

Attach a weight holding device 100 to a dumbbell. Lie down on your back on one end of the bench and hold a weight holding device 100 with both hands above your chest area, arms extended. Raise the weight holding device 100 straight up until your arms are perpendicular to the floor and lower it back after a short pause.

Legs

Overhead Lunges

Stand with a weight holding device 100 attached to a dumbbell in each hand. Raise a weight holding device 100 overhead with arms aligning with the ears. Take a step forward sending the knee into a 90° bend keeping them overhead. Push out of the knee bend back into the starting position. Repeat movement with the opposite leg keeping them overhead the entire duration of the exercise. This exercise can be done using the same leg repeatedly with two weight holding devices 100.

Deadlifts

Stand with a weight holding device 100 attached to a dumbbell in each hand. Bend both knees slightly and bend over at the waist taking the weight holding device 100 down close to the floor. Before hitting the floor reverse the movement and go back to the upright, starting position. Keep repeating movement for a complete set. This exercise can also be done with one leg and one arm or one leg and two arms or two legs and one arm.

Dumbbell Walk

Stand with a weight holding device 100 attached to a dumbbell in each hand. Proceed to walk across the space or area, keeping them down to the sides. Reach destination and repeat for desired distance.

Alternating Step Ups

Stand in front of a stepper with a weight holding device 100 attached to a dumbbell in each hand Proceed to step up with one leg on the stepper and the opposite leg raising about 45°. Proceed to step down with the opposite leg first followed by the starting leg to start position. Continue by stepping up with the opposite leg and continue movements previously mentioned alternating legs. This exercise can also be done by stepping up with one leg continuously also.

Stairs

Stand with a weight holding device 100 attached to a dumbbell in each hand. Start at the bottom of a staircase. Keeping both arms down to the sides Proceed to step up and climb the staircase. Once the top of the staircase is reached, turn around and proceed down the stairs keeping them down to the sides.

High Dumbbell Squats

Stand with a weight holding device 100 attached to a dumbbell in each hand. Holding a weight holding device 100 in each hand, bend the elbows, raising the hands just below jaw level. Keeping the elbows narrow go into a 90° knee bend with both knees. Then push out of the knee bends, going up to the starting upright position. Keep the elbows bent with both hands at jaw level during the entire duration of the exercise. Repeat the knee bends for a complete set.

Walking Lunges

Stand with a weight holding device 100 attached to a dumbbell in each hand. Step 1 foot forward going into a 90° knee bend. Pushing off your back leg, push forward to an up-right position for a complete step. Repeat with the opposite leg. Proceed across a wide area or space.

Alternating Back Lunges

Stand with a weight holding device 100 attached to a dumbbell in each hand. Take a step back and go into a 90° knee bend. Push out of the bend coming back up into the starting, upright position. Repeat on the opposite leg.

Overhead Squats

Stand with a weight holding device 100 attached to a dumbbell in each hand. Lift both arms overhead with them aligned with the ears. With them overhead, go into a 90° knee bend. Come out of the 90° knee bend back into the starting upright position. Keep them overhead for the entire exercise and repeat the knee bends.

One Leg One Arm Dumbbell Touchdown

Stand on one leg holding a weight holding device 100 attached to a dumbbell. Keeping a slight bend in your standing leg bend over as to take the weight holding device 100 towards the standing foot. Stop right before touching the foot and come back up to the starting upright position. Repeat for a complete set on one leg then change to the opposite leg.

Squat

Stand with a weight holding device 100 attached to a dumbbell in each hand in front of your thighs. Lower your body by bending your knees until they form a 90 degree angle and raise yourself back up after a short pause.

Reverse Lunge

Stand with a weight holding device 100 attached to a dumbbell in each hand along the sides of your body, palms facing your body. Place a foot back and bend your knees in order to bring down your body until your knees form 90 degree angles and raise yourself back up after a short pause.

Stationary Lunge

Stand up with one foot in front, one foot back and hold a weight holding device 100 attached to a dumbbell in each hand along the sides of your body, palms facing each other. Lower yourself without moving your feet until your knees form 90 degree angles and raise yourself back up after a short pause.

Side Lungs

Stand with a weight holding device 100 attached to a dumbbell in each hand against the sides of your body, palms facing each other. Take a wide step sideways so that your knee shows a 90 degree angle and slowly bring yourself back up after a short pause.

Stiff Legged Dead Lift

Stand with a weight holding device 100 attached to a dumbbell in each hand against the sides of your body, palms facing each other. Lower the weight holding device 100 by bending your hips forward and raise yourself back up again after a short pause.

Alternating Lunges

Stand with a weight holding device 100 attached to a dumbbell in each hand. Take one leg forward into a 90° bend. Push out of the bend into the starting, upright position. Repeat with the opposite leg.

Toe Raise

Stand with a weight holding device 100 attached to a dumbbell in each hand against the sides of your body, palms facing each other. Lift your heels from the ground by pushing on your toes and lower yourself back down after a short pause.

Back

Wide Row

Stand with a weight holding device 100 attached to a dumbbell in each hand and flex your knees and hips to bring yourself to a squatting position. Lift both dumbbells straight up without altering the angles of your knees and hips and lower them back after a short pause.

Prone Incline Bench Flys

Incline a bench. Set in place two weight holding devices 100 attached to two dumbbells. Get positioned face down on the bench in a straddle position and grab the weight holding device 100. With them straight, lift arms out to each side to the point of parallel to the floor or until a squeeze between the should blades is felt. Lower arms back down to starting position and repeat for desired number of repetitions.

Bent Over Row

Stand with a weight holding device 100 attached to a dumbbell in each hand (knees slightly bent). Lift the weight holding device 100 up until your upper arms are parallel to your body and lower them back after a short pause. This exercise can be done in a staggered stance and/or with one arm or alternating arms also.

Kneeling One Arm Row

Put your left side knee and hand on a bench and grab a weight holding device 100 attached to a dumbbell, with your right hand. Lift the holding device straight up without moving anything else than your arm and lower it back down after a short pause.

One Arm Row

Position yourself bent forward in front of a bench while holding a weight holding device 100 with one hand (arm extended). Lift the weight holding device 100 up until your upper arm is parallel to your body and lower it back after a short pause. Alternate hands when set is completed.

Dead Lift

Stand with a weight holding device 100 attached to a dumbbell in each hand. Flex your knees and hips in order to lower the weight holding device 100 straight down and raise yourself back up after a short pause. This exercise can also be done with one leg.

Stiff Legged Dead Lift

Stand with a weight holding device 100 attached to a dumbbell in each hand with both hands (knees slightly bent). Raise your upper body until you are standing and lower it back after a short pause.

Back Fly

Attach two weight holding devices 100 to two dumbbells. Lie down on your chest on the bench and the weight holding device 100 *s*, elbows at 90 degree angles. Raise the weight holding device 100 until your arms are parallel to the ground and lower them back after a short pause.

Biceps

One-at-a-Time Biceps Curl

Stand with a weight holding device 100 attached to a dumbbell in each hand, palms facing forward. One arm at a time, raise one a weight holding device 100 by curling your elbow and lower it back down after a short pause. Repeat on opposite side.

Alternated Biceps Curl

Stand with a weight holding device 100 attached to a dumbbell in each hand down the side of your body, palms facing each other. Raise one a weight holding device 100 until it reaches your shoulder's height and while slowly lowering it back down after a short pause, start raising the other one.

Inner-Biceps Curl

Stand with a weight holding device 100 attached to a dumbbell in each hand down the side of your body, palms facing each other. Raise both weight holding devices 100 until they reach your shoulders' height and slowly lower them down after a short pause.

Standing Reverse Bicep Curls

Stand with a weight holding device 100 attached to a dumbbell in each hand. Raise both a weight holding device 100 with back of hand facing the ceiling. Raise to about a 45 degree bend in the elbows, then lower back down to starting position. This exercise can be done with one arm or alternating arms also.

Seated Alternated Biceps Curl

Sit down on a bench with a weight holding device 100 attached to a dumbbell in each hand down the side of your body, palms facing each other. Raise one a weight holding device 100 until it reaches your shoulder's height and while slowly lowering it back down after a short pause, start raising the other one.

Seated Biceps Curl

Sit down on a bench with a weight holding device 100 attached to a dumbbell in each hand down the side of your body, palms facing each other. Raise both a weight holding device 100 until they reach your shoulders' height and slowly lower them down after a short pause.

Incline Alternated Biceps Curl

Sit down on an inclined bench with a weight holding device 100 attached to a dumbbell in each hand down, palms facing each other. Raise one a weight holding device 100 until it reaches your shoulder's height and while slowly lowering it back down after a short pause, start raising the other one.

Incline Biceps Curl

Sit down on an inclined bench with a weight holding device 100 attached to a dumbbell in each hand down, palms facing each other. Raise both a weight holding device 100 until they reach your shoulders' height and slowly lower them back down after a short pause.

Incline Biceps Bench Curl

Sit down on an inclined bench with a weight holding device 100 attached to a dumbbell in each hand down the sides of your body, palms facing each other. Raise both a weight holding device 100 until they reach your shoulder levels and lower them back down after a short pause.

Seated Inner-Biceps Curl

Sit down on a bench with a weight holding device 100 attached to a dumbbell in each hand down the side of your body, palms facing each other. Raise both a weight holding device 100 until they reach your shoulders' height and slowly lower them back down after a short pause.

Seated Concentration Curl

Sit on a bench, rest one arm against your thigh and hold a weight holding device 100 with that hand down between your legs, palm facing the other leg. Raise the weight holding device 100 until it reaches your shoulder and slowly lower it back down after a short pause. Alternate after a set.

Seated Isolated Dumbbell Curl

Sit on one end of the bench, hold one a weight holding device 100 with a dumbbell attached with your hand and place that hand's elbow (extended) against the front of your thigh. Raise one a weight holding device 100 until it reaches your shoulder's height and slowly lower it back down after a short pause. Alternate after a set.

Preacher Biceps Curl (Supination Grip)

Place one upper arm against them pad the other at a 90 degree angle and grab a weight holding device 100 attached to a dumbbell in each hand, palms facing up. Raise the weight holding device 100 alternatively until your forearms are parallel to the floor and lower them back down alternatively after a short pause.

Preacher Biceps Curl (Neutral Grip)

Place one upper arm against them pad the other at a 90 degree angle and grab a weight holding device 100 attached to a dumbbell in each hand palms facing each other. Raise the weight holding device 100 alternatively until your forearms are parallel to the floor and lower them back down alternatively after a short pause.

Bench Alternated Biceps Curl

Lie face down on a high bench and hold a weight holding device 100 attached to a dumbbell in each hand straight below your shoulders. Raise one a weight holding device 100 until it reaches your shoulder's height and while slowly lowering it back down after a short pause, start raising the other one.

Tricep Exercises

One-Arm Triceps Extension

Stand up and hold a weight holding device 100 with a dumbbell attached with one hand behind your head, elbow at a 90 degree angle, upper arm straight up. Raise the weight holding device 100 with one hand until your arm is close to being fully extended and slowly lower it back after a short pause. Alternate after a set.

Triceps Kickback

Put your knee and hand on a bench and grab a weight holding device 100 with a dumbbell attached with your other hand, palm facing your body, upper arm parallel to your body (This exercise can also be done with an inclined bench). Push the weight holding device 100 back by extending your elbow and allow it to slowly return after a short pause.

Bent-Over One-Arm Triceps Extension

Sit down, crouch forward and hold a weight holding device 100 with a dumbbell attached with one hand, elbow at a 90 degree angle, palm facing your body. Raise the weight holding device 100 with one hand until your arm is parallel to the ground and slowly lower it back after a short pause. Alternate after a set.

Lying Triceps Extension

Attach two weight holding devices 100 to two dumbbells. Lie down on your back on a bench with a weight holding device 100 *s*, palms facing up, upper arms pointing the ceiling. Raise the weight holding device 100 by extending your elbows and allow them to slowly return after a short pause. Repeat until the desired number of repetitions are reached (This exercise can be done with one arm or alternating arms also).

Triceps Bench Press

Attach two weight holding devices 100 to two dumbbells. Lie down on your back on a bench and hold the weight holding device 100 on your sides just above your chest, palms facing each other. Push the weight holding device 100 straight up until your arms are close to being fully extended and slowly lower them back after a short pause.

Shoulders

Shoulder Press

Stand up and hold a weight holding device 100 with a dumbbell attached in each hand close to your shoulders, palms facing forward. Raise the weight holding device 100 straight up until your elbows come close to locking and lower them back after a short pause (This exercise can be done with one arm or alternating arms also).

Lateral Raise

Stand up and hold a weight holding device 100 with a dumbbell attached in each hand in front of your hips, palms facing each other. Raise the weight holding device 100 to your sides until your arms are close to being parallel to the ground and lower them back down after a short pause.

Seated Side Lateral Raise

Sit on one end of the bench and hold a weight holding device 100 with a dumbbell attached in each hand down the side of your body. Raise both a weight holding device 100 sideways until your arms are parallel to the ground and lower them back down slowly after a short pause.

Bent-Over Rear Deltoid Raise

Sit on one end of the bench and lower your torso towards your thighs holding a weight holding device 100 with a dumbbell attached in each hand close to the floor. Raise both a weight holding device 100 to your sides until your arms are close to being parallel to the ground and lower them back down slowly after a short pause.

Rear Deltoid Raise

Lie down on a high bench (face down) with a weight holding device 100 with a dumbbell attached in each hand below your chest, arms slightly bent. Raise both a weight holding device 100 to your sides until your arms are close to being parallel to the ground and lower them back down slowly after a short pause.

Straight-Arm Front Deltoid Raise

Stand up and hold a weight holding device 100 with a dumbbell attached in each hand in front of your thighs. Raise the weight holding device 100 to your shoulder level and continue on to raising them up at arms' length or parallel to the floor and lower them back down slowly after a pause (This exercise can be done with one arm or alternating arms also).

Upright Row

Stand up and hold a weight holding device 100 with a dumbbell attached in each hand in front of your thighs. Raise both dumbbells until your arms are parallel to the ground and lower them back down slowly after a short pause.

Front Raise

Stand up and hold a weight holding device 100 with a dumbbell attached in each hand in front of your thighs, palms facing your body. Raise the weight holding device 100 forward then up until your arms are close to being parallel to the ground and lower them back down after a short pause.

Shoulder Shrug

Stand up and hold a weight holding device 100 with a dumbbell attached in each hand in front of your thighs, palms facing your body. Raise the weight holding device 100 straight up by raising your shoulders and lower them back after a short pause.

Push Press

Stand up and hold a weight holding device 100 with a dumbbell attached in each hand, just above your shoulders, palms facing each other, knees arched. Push the weight holding device 100 straight up until your arms are close to locking and lower them back down slowly after a short pause.

Crouched Rear Deltoid Row

Crouch by bending your hips and knees and hold a weight holding device 100 with a dumbbell attached in each hand close to your knees, palms facing backwards. Raise the weight holding device 100 straight up until your elbows form a 90 degree angle and lower them back down after a short pause.

Forearms

Palms-Up Wrist Curl

Sit on one end of a bench and hold a weight holding device 100 with a dumbbell attached in each hand, wrists against your knees, palms facing up. Raise the weight holding device 100 up by raising only your hands and slowly lower them back down after a short pause.

One-Arm Palm-Up Wrist Curl

Sit on one end of a bench and hold a weight holding device 100 with a dumbbell attached with one hand, wrist against your knee, palm facing up. Raise the weight holding device 100 up by raising only your hand and slowly lower it back down after a short pause. Alternate hands after a set.

Palms-Down Wrist Curl

Sit on one end of a bench and hold a weight holding device 100 with a dumbbell attached in each hand, wrists against your knees, palms facing down. Raise the weight holding device 100 up by raising only your hands and slowly lower them back down after a short pause.

One-Arm Palm-Down Wrist Curl

Sit on one end of a bench and hold a weight holding device 100 with a dumbbell attached with one hand, wrist against your knee, palm facing down. Raise the weight holding device 100 up by raising only your hand and slowly lower it back down after a short pause. Alternate hands after a set.

Leg Combos

One Leg One Arm Dumbbell Touchdown to Overhead Press

Stand on one leg holding a weight holding device 100 with a dumbbell attached. Keeping a slight bend in your standing leg. Bend over as to take the weight holding device 100 towards the standing foot. Stop right before touching the foot and come back up to the starting upright position, Proceed to lifting the weight holding device 100 overhead into a full straight elbow press. Lower the weight holding device 100 to the starting standing position Repeat for a complete set on one leg then change to the opposite leg.

One Leg Two Arm Dumbbell Touchdown to Overhead Press

Stand on one leg holding a weight holding device 100 with a dumbbell attached in each hand. Keeping a slight bend in your standing leg. Bend over as to take the weight holding device 100 towards the floor. Stop right before touching the floor and come back up to the starting upright position, Proceed to lifting the weight holding device 100 overhead into a full straight elbow press. Lower the weight holding device 100 to the starting standing position Repeat for a complete set on one leg then change to the opposite leg.

Two Leg Two Arm Dumbbell Touchdown to Overhead Press

Stand holding a weight holding device 100 with a dumbbell attached in each hand. Keeping a slight bend in both knees. Bend over as to take the weight holding device 100 towards the floor. Stop right before touching the floor and come back up to the starting upright position, Proceed to lifting the weight holding device 100 overhead into a full straight elbow press. Lower the weight holding device 100 to the starting standing position Repeat for a complete set.

Two Leg One Arm Dumbbell Touchdown to Overhead Press

Stand holding a weight holding device 100 with a dumbbell attached in 1 hand. Keeping a slight bend in both knees. Bend over as to take the weight holding device 100 towards the floor. Stop right before touching the floor and come back up to the starting upright position, Proceed to lifting the weight holding device 100 overhead into a full straight elbow press. Lower the weight holding device 100 to the starting standing position Repeat for a complete set.

One Side Step Up & Two Arm Overhead Press

Stand holding a weight holding device 100 with a dumbbell attached in each hand. Step one leg up to a stepper or stair. Step up onto the stepper or stair with both arms down to the side. Proceed to lift the weight holding device 100 overhead to a full straight elbow press. While bringing them down, step back onto the floor leading with the non-step up leg. Keep repeating for a complete set (This exercise can be done with alternating legs step ups, or With one arm or two arm overhead presses).

Alternating Lunges and Lateral Raise

Stand holding a weight holding device 100 with a dumbbell attached in each hand. Step forward sending the knee into a 90° bend While simultaneously raising both a weight holding device 100 straight out to the sides. Push out of The lunge going back to the starting position while simultaneously lowering the weight holding device 100 to the sides. Repeat with the opposite leg.

Alternating Lunge and Press

Stand holding a weight holding device 100 with a dumbbell attached in each hand. Step forward sending the knee into a 90° bend while simultaneously raising the weight holding device 100 overhead into a straight press. Push out of the lunge back to the starting position while simultaneously lowering the weight holding device 100 to the sides. Repeat on the opposite leg (This exercise could be done repeating one side and one dumbbell or 1 side and two dumbbells).

Alternating Lunge and Press 2

Stand holding a weight holding device 100 with a dumbbell attached in each hand. Step forward going into a 90° bend at the knee. Push out of the lunge going back to the starting position While simultaneously raising both a weight holding device 100 overhead into a press. Repeat with the opposite leg (This exercise can be done repeating one leg and two weight holding devices 100 or one leg and one a weight holding device 100).

Squat and Overhead Press

Stand holding a weight holding device 100 with a dumbbell attached in each hand. Raise the weight holding device 100 by bending the elbows, keeping them narrow and holding hands just below the jaw level. Bend both knees into a 90° angle. Raise back up into the starting position. Repeat for a complete set while keeping them up the entire duration of the exercise (This exercise can also be done on one leg using two weight holding devices 100 or one leg using one a weight holding device 100).

Squat & Later Raise

Stand holding a weight holding device 100 with a dumbbell attached in each hand. Go down sending the knees into a 90° bend While simultaneously raising both a weight holding device 100 out to the sides until them are parallel to the floor. Push out of the lunge back into the starting position while simultaneously lowering each arm too it's side. Repeat with the opposite leg (This exercise can be done repeating with one leg)

Squat and Curls

Stand holding a weight holding device 100 with a dumbbell attached in each hand. Squat sending both knees into a 90° bend. Push out of the bend into the starting position While simultaneously bending the Elbows into 160° bend. Lower them to the sides and repeat movement (This exercise can be done using one leg and one arm or two legs and one arm or two legs and one arm.

Alternating Lunges and Curl

Stand holding a weight holding device 100 with a dumbbell attached in each hand. Step 1 foot forward sending the knee into a 90° bend While simultaneously curling both a weight holding device 100 into a 160° angle at the elbows. Push out of the lunge while simultaneously lowering the weight holding device 100 back down to each side. Repeat movement with the opposite leg going forward.

Underhand Pull Ups

Attach the weight holding device 100 to a bar, overhead bar, or any structure that can support proper body weight, with the same mechanism as attached to a dumbbell handle. Make sure the handles hang and is accessible for gripping. Attach body weight by gripping handles with an underhand grip and lifting weight off the ground by bending the elbows to come up to desired height. Lower the body back down to the starting position and repeat for desired number of repetitions. This exercise can also be done while keeping any portion of the body in contact with the ground.

Bar

Standing Bar Overhead Triceps Extensions (Holding Device at Ends)

Attach a weight holding device 100 to two dumbbells. Shift handles on Weight holding devices 100 to the hanging position. Attach weight holding device 100 to pole, bar, or elongated rod that can support the selected weight at each of its ends. Grab rod And proceed to lift devices towards ceiling until arms are almost straight. Lower back down to about 90° elbow flexion behind head. Push out of bend by returning arms to straight overhead position and continue to repeat for desired number of repetitions. This exercise can also be done in a seated position.

Bar Bent Over Rows (Holding Device at Ends)

Attach two weight holding devices 100 to two dumbbells. Shift handles on weight holding devices 100 to the hanging position. Attach the two weight holding devices 100 to a pole, bar, or elongated rod that can support the selected weight at each of its ends. Grab rod with an overhand grip and stand straight up. Bend the knees to about a 135° angle. Then bend over at the waist about 45° while keeping the shoulders back and down away from the neck. Extend the bar out away from the body until them are almost straight. Row the bar up towards the chest with the elbows in or out until a squeeze in between the shoulder blades. Lower the rod back down to starting position and repeat for desired number of repetitions. This exercise can also be done in a staggered stance position.

Bar Overhead Squats (Holding Device at Ends)

Attach two weight holding devices 100 to two dumbbells. Shift handles on weight holding devices 100 to the hanging position. Attach the two weight holding devices 100 to a pole, bar, or elongated rod that can support the selected weight at each of its ends. Grab rod with overhand grip. Raise bar straight overhead with arms straight. Squat down by bending the knees to a 90° angle. Push out of the squats and return to the starting position With arms still overhead, repeat the same movement for desired number of repetitions (this exercise can also be done by holding bar at chin level while performing the squats).

Bar Deadlifts (Holding Device at Ends)

Attach two weight holding devices 100 to two dumbbells. Shift handles on weight holding devices 100 to the hanging position. Attach the two weight holding devices 100 to a pole, bar, or elongated rod that can support the selected weight at each of its ends. Grab bar with overhand grip. Stand with bar in front of thighs. Bend over at the waist to about a 45°-90° angle while keeping a slight bend in the knees. Raise out of the waist bend and return to starting position. Repeat movement for desired number of repetitions. This exercise can also be performed in a staggered stance.

Bar Lunge and Press (Holding Device at Ends)

Attach two weight holding devices 100 to two dumbbells. Shift handles on weight holding devices 100 to the hanging position. Attach the two weight holding devices 100 to a pole, bar, or elongated rod that can support the selected weight at each of its ends. Grab rod with overhand grip. Raise rod to about chin level. Step one leg forward, sending the knee into a 90° bend. Push out of the bend and return to starting position while simultaneously raising bar overhead until arms are almost straight. Return bar to chin level and repeat the same movement with the opposite leg. Repeat movement, alternating legs for the desired number of repetitions (this exercise can also be performed lunging with same foot before switching to opposite foot).

Bar Squats and Press (Holding Device at Ends)

Attach two weight holding devices 100 to two dumbbells. Shift handles on weight holding devices 100 to the hanging position. Attach the two weight holding devices 100 to a pole, bar, or elongated rod that can support the selected weight at each of its ends. Grab bar with overhand grip. Raise bar to about chin level. Squat down sending both knees into a 90° bend. Push out of bend and return to starting position while simultaneously raising bar overhead until arms are almost straight. Return bar to chin level. Repeat movement for the desired number of repetitions.

Bar Alternating Step Ups (Holding Device at Ends)

Attach two weight holding devices 100 to two dumbbells. Shift handles on weight holding devices 100 to the hanging position. Attach the two weight holding devices 100 to a pole, bar, or elongated rod that can support the selected weight at each of its ends. Grab bar with overhand grip. Raise devices to about chin level. With stepper or step in front of feet, step up with one leg onto step. Follow through raising the opposite leg about 45° hip flexion. Step down with non-standing foot first, then follow through with the initiating foot until both feet are on the floor at starting position. Repeat movement, first stepping up with opposite foot. Alternate step ups for desired number of repetitions while keeping bar at chin level throughout the exercise (this exercise can also be performed stepping up with the same foot for desired repetitions before switching to opposite foot).

Bar Alternating Lateral Squats (Holding Device at Ends)

Attach two weight holding devices 100 to two dumbbells. Shift handles on weight holding devices 100 to the hanging position. Attach the two weight holding devices 100 to a pole, bar, or elongated rod that can support the selected weight at each of its ends. Grab rod with overhand grip. Raise rod to about chin level. Step 1 foot out to the side while simultaneously squatting into a 90° knee bend at both knees. Push out if the squat while simultaneously stepping back over to starting position. Repeat the same movement with the opposite leg for desired number of repetitions while keeping devices at chin level throughout the rod (this exercise can also be performed by squatting with the same foot before switching sides).

Device Standing Bar Overhead Triceps Extensions

Attach a weight holding device 100 to weighted pole, bar, or and elongated rod. Space a weight holding device 100 shoulder width apart. Grab a weight holding device 100 And proceed to lift a weight holding device 100 towards ceiling until arms are almost straight. Lower back down to about 90° elbow flexion behind head. Push out of bend by returning arms to straight overhead position and continue to repeat for desired number of repetitions (this exercise can also be done in a seated position also).

Device Bar Bent Over Rows

Attach a weight holding device 100 to a weighted pole, bar, or elongated rod. Space a weight holding device 100 shoulder width apart. Grab a weight holding device 100 with an overhand grip and stand straight up. Bend the knees to about a 135° angle. Then bend over at the waist about 45° while keeping the shoulders back and down away from the neck. Extend the weight holding device 100 out away from the body until them are almost straight. Row the weight holding device 100 up towards the chest with the elbows in or out until a squeeze in between the shoulder blades. Lower the weight holding device 100 back down to starting position and repeat for desired number of repetitions (this exercise can also be done in a staggered stance position also).

Device Bar Overhead Alternating lunges

Attach a weight holding device 100 to weighted pole, bar, or elongated rod. Space a weight holding device 100 shoulder width apart. Grab a weight holding device 100 with overhand grip. Raise bar straight overhead with arms straight. Step 1 foot out sending the knee into a 90° bend. Push out of bend and step back into starting position. With arms still overhead, repeat the same movement with the opposite leg. Alternate legs for desired number of repetitions (this exercise can also be done by holding a weight holding device 100 at chin level while performing the lunges and or lunging with same foot before switching to opposite foot).

Device Bar Overhead squats

Attach a weight holding device 100 to weighted pole, bar, or elongated rod. Space a weight holding device 100 shoulder width apart. Grab a weight holding device 100 with overhand grip. Raise a weight holding device 100 straight overhead with arms straight. Squat down by bending the knees to a 90° angle. Push out of the squats and return to the starting position with arms still overhead, repeat the same movement for desired number of repetitions (this exercise can also be done by holding a weight holding device 100 at chin level while performing the squats).

Device Bar Deadlifts

Attach a weight holding device 100 to weighted pole, bar, or elongated rod. Space a weight holding device 100 shoulder width apart. Grab a weight holding device 100 with overhand grip. Stand with a weight holding device 100 in front of thighs. Bend over at the waist to about a 45°-90° angle while keeping a slight bend in the knees. Raise out of the waist bend and return to starting position. Repeat movement for desired number of repetitions (this exercise can also be performed in a staggered stance).

Device Bar Lunge and Press

Attach a weight holding device 100 to weighted pole, bar, or elongated rod. Space a weight holding device 100 shoulder width apart. Grab a weight holding device 100 with overhand grip. Raise a weight holding device 100 to about chin level. Step one leg forward, sending the knee into a 90° bend. Push out of the bend and return to starting position while simultaneously raising a weight holding device 100 overhead until arms are almost straight. Return a weight holding device 100 to chin level and repeat the same movement with the opposite leg. Repeat movement, alternating legs for the desired number of repetitions (this exercise can also be performed lunging with same foot before switching to opposite foot).

Device Bar Squats and Press

Attach a weight holding device 100 to weighted pole, bar, or elongated rod. Space a weight holding device 100 shoulder width apart. Grab a weight holding device 100 with overhand grip. Raise a weight holding device 100 to about chin level. Squat down sending both knees into a 90° bend. Push out of bend and return to starting position while simultaneously raising a weight holding device 100 overhead until arms are almost straight. Return a weight holding device 100 to chin level. Repeat movement for the desired number of repetitions.

Device Bar Alternating Step Ups

Attach a weight holding device 100 to weighted pole, bar, or elongated rod. Space a weight holding device 100 shoulder width apart. Grab a weight holding device 100 with overhand grip. Raise a weight holding device 100 to about chin level. With stepper or step in front of feet, step up with one leg onto step. Follow through raising the opposite leg about 45° hip flexion. Step down with non-standing foot first, then follow through with the initiating foot until both feet are on the floor at starting position. Repeat movement, first stepping up with opposite foot. Alternate step ups for desired number of repetitions while keeping a weight holding device 100 at chin level throughout the exercise. This exercise can also be performed stepping up with the same foot for desired repetitions before switching to opposite foot.

Device Bar Alternating Lateral Squats

Attach a weight holding device 100 to weighted pole, bar, or elongated rod. Space a weight holding device 100 shoulder width apart. Grab a weight holding device 100 with overhand grip. Raise a weight holding device 100 to about chin level. Step 1 foot out to the side while simultaneously squatting into a 90° knee bend at both knees. Push out if the squat while simultaneously stepping back over to starting position. Repeat the same movement with the opposite leg for desired number of repetitions while keeping a weight holding device 100 at chin level throughout the exercise (this exercise can also be performed by squatting with the same foot before switching sides).

The weight holding device 100, as described herein, meets the existing need for a device that presents an unstable force to an athlete, thereby providing different challenges, stimuli and recruitment to the athlete's targeted muscles and integrating additional muscles, in part because a weight has some freedom of movement when it is suspended by the weight holding device 100, rather than having its freedom of movement restricted by the direct grip required with conventional weights.

In addition, the weight holding device 100, as described herein, provides the athlete with a less monotonous and more comfortable way to exercise with a weight, in part because the free movement of a suspended weight provides more variation of force during use than an unsuspended weight, and because it is possible for an athlete to hold a suspended weight in a more comfortable position than an unsuspended weight.

While a particular form and use of the present invention has been described above, the invention is not limited to the specific arrangement of parts or manner of use described.

One skilled in the art understands that modifications to the construction and use of the present system may be made without departing from the scope of the invention.

Although the invention has been described in terms of exemplary embodiments, it is not limited thereto. Rather, the appended claims should be construed broadly to include other variants and embodiments of the invention that may be made by those skilled in the art without departing from the scope and range of equivalents of the invention. This disclosure is intended to cover any adaptations or variations of the embodiments discussed herein.

What is claimed is:

1. A method of using a weight holding device,
wherein the weight holding device comprises:
a strap substantially consisting of a flexible material and having a width and a length,
a strap-separating component attached to the strap,
a substantially flat plate cover, and
a handgrip attached to the strap,
wherein the strap-separating component is a substantially flat and rectangular plate attached to the strap and substantially enclosed by the plate cover, the plate having a width and a length, the width of the plate not greater than the width of the strap,
wherein the strap-separating component maintains a separation substantially equal to the length of the plate between two portions along the length of the strap when a weight is suspended from the weight holding device, and
the method comprising the steps of:
positioning the strap behind a bar, wherein the handgrip is positioned opposite the strap-separating component, and the strap is suspended from the handgrip,
raising a lowest portion of the strap,
bringing the handgrip through a raised portion of the strap, and
pulling the handgrip upwards so that the strap tightens around the bar.

2. The method of claim 1, further comprising the steps of:
gripping the weight holding device by the handgrip, and
raising the weight holding device.

3. The method of claim 1, wherein the strap is a continuous closed loop.

4. The method of claim 1, wherein the strap is substantially flat.

5. The method of claim 1, wherein the handgrip is substantially cylindrical and hollow, and the strap is routed through the handgrip.

6. The method of claim 1, further comprising the step of:
sliding the handgrip down away from an upmost portion of the strap.

7. The method of claim 6, further comprising the step of:
suspending the weight holding device from the bar.

8. A method of using a weight holding device,
wherein the weight holding device comprises:
a strap substantially consisting of a flexible material and having a width and a length,
a strap-separating component attached to the strap,
a substantially flat plate cover, and
a handgrip attached to the strap,
wherein the strap-separating component is a substantially flat and rectangular plate attached to the strap and substantially enclosed by the plate cover, the plate having a width and a length, the width of the plate not greater than the width of the strap,
wherein the strap-separating component maintains a separation substantially equal to the length of the plate between two portions along the length of the strap when a weight is suspended from the weight holding device, and the method comprising the steps of:

positioning the strap behind a bar, wherein the strap-separating component is positioned above the bar and the handgrip is positioned opposite the strap-separating component and below the bar, lowering a highest portion of the strap, bringing the handgrip through a lowered portion of the strap, and pulling the handgrip downwards so that the strap tightens around the bar.

9. The method of claim 8, further comprising the steps of:

gripping the weight holding device by the handgrip, and lifting a user's body.

10. The method of claim 8, wherein the strap is a continuous closed loop.

11. The method of claim 8, wherein the strap is substantially flat.

12. The method of claim 8, wherein the handgrip is substantially cylindrical and hollow, and the strap is routed through the handgrip.

13. A method of using two weight holding devices, wherein each weight holding device comprises:

a strap substantially consisting of a flexible material and having a width and a length, a strap-separating component attached to the strap, a substantially flat plate cover, and a handgrip attached to the strap, wherein the strap-separating component is a substantially flat and rectangular plate attached to the strap and substantially enclosed by the plate cover, the plate having a width and a length, the width of the plate not greater than the width of the strap, wherein the strap-separating component maintains a separation substantially equal to the length of the plate between two portions along the length of the strap when a weight is suspended from the weight holding device, and the method comprising the steps of:

positioning the strap of each weight holding device behind a bar, wherein the strap-separating component of each weight holding device is positioned above the bar and the handgrip of each weight holding device is positioned opposite the corresponding strap-separating component and below the bar, lowering a highest portion of the strap of each weight holding device, bringing the handgrip of each weight holding device through a lowered portion of the strap of each weight holding device, and pulling the handgrip of each weight holding device downwards so that the strap of each weight holding device tightens around the bar.

14. The method of claim 13, further comprising the steps of:

gripping the handgrip of each weight holding device, and lifting a user's body.

15. The method of claim 13, wherein the strap of each weight holding device is a continuous closed loop.

16. The method of claim 13, wherein the strap of each weight holding device is substantially flat.

17. The method of claim 13, wherein the handgrip of each weight holding device is substantially cylindrical and hollow, and the strap of each weight holding device is routed through the corresponding handgrip.

* * * * *